US010103437B2

(12) United States Patent
Huang

(10) Patent No.: US 10,103,437 B2
(45) Date of Patent: Oct. 16, 2018

(54) MULTI-BAND ANTENNA

(71) Applicant: PEGATRON CORPORATION, Taipei (TW)

(72) Inventor: Chin-Ting Huang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 78 days.

(21) Appl. No.: 15/331,920

(22) Filed: Oct. 24, 2016

(65) Prior Publication Data

US 2017/0141469 A1 May 18, 2017

(30) Foreign Application Priority Data

Nov. 12, 2015 (TW) ..... 104137367 A

(51) Int. Cl.

| | |
|---|---|
| ***H01Q 5/50*** | (2015.01) |
| ***H01Q 1/24*** | (2006.01) |
| ***H01Q 1/38*** | (2006.01) |
| ***H01Q 1/50*** | (2006.01) |
| ***H01Q 7/00*** | (2006.01) |
| ***H01Q 9/30*** | (2006.01) |
| ***H01Q 9/42*** | (2006.01) |
| ***H01Q 5/328*** | (2015.01) |
| ***H01Q 5/335*** | (2015.01) |
| ***H01Q 5/364*** | (2015.01) |
| ***H01Q 5/371*** | (2015.01) |

(52) U.S. Cl.

CPC ..... *H01Q 5/50* (2015.01); *H01Q 1/243* (2013.01); *H01Q 1/38* (2013.01); *H01Q 1/50* (2013.01); *H01Q 5/328* (2015.01); *H01Q 5/335* (2015.01); *H01Q 5/364* (2015.01); *H01Q 5/371* (2015.01); *H01Q 7/00* (2013.01); *H01Q 9/30* (2013.01); *H01Q 9/42* (2013.01)

(58) Field of Classification Search

CPC ..... H01Q 5/50; H01Q 5/328; H01Q 5/335; H01Q 5/364; H01Q 5/371; H01Q 1/243; H01Q 1/38; H01Q 1/50; H01Q 9/30; H01Q 9/42; H01Q 7/00

See application file for complete search history.

(56) References Cited

U.S. PATENT DOCUMENTS

| | | | | |
|---|---|---|---|---|
| 9,331,397 | B2 * | 5/2016 | Jin | H01Q 21/28 |
| 2007/0182638 | A1 | 8/2007 | Rowell | |
| 2015/0057054 | A1 * | 2/2015 | Su | H01Q 1/243 455/575.7 |
| 2015/0236426 | A1 * | 8/2015 | Zhu | H01Q 13/10 343/702 |

FOREIGN PATENT DOCUMENTS

| | | | |
|---|---|---|---|
| CN | 104064865 | A | 9/2014 |

* cited by examiner

*Primary Examiner* — Dameon E Levi
*Assistant Examiner* — David Lotter
(74) *Attorney, Agent, or Firm* — CKC & Partners Co., Ltd.

(57) ABSTRACT

A multi-band antenna includes a metal backing plate, a radiating conductor, a non-conductor and a connector. The non-conductor is interleaved between the metal backing plate and the radiating conductor. The connector is connected to the metal backing plate and the radiating conductor, and the connector is configured to adjust a connection path between the metal backing plate and the radiating conductor to adjust an antenna operation band.

10 Claims, 20 Drawing Sheets

MULTI-BAND ANTENNA

RELATED APPLICATIONS

This application clams priority to Taiwan Application Serial Number 104137367, filed Nov. 12, 2015, which is herein incorporated by reference.

BACKGROUND

Field of Invention

The present disclosure relates to a multi-band antenna. More particularly, the present disclosure relates to a multi-band antenna which is integrated with a metal backing plate.

Description of Related Art

In recent years, manufacturers continuously release mobile phones integrated with a metal backing plate. Multiple plastic slots are arranged on the metal backing plate of the current mobile phone integrated with the metal backing plate, and a slit is arranged on a system board. The slit is mainly configured for antenna radiation.

The existence of the plastic slots is an obstacle for optimizing the appearance of a mobile phone integrated with the metal backing plate. However, if there is no plastic slot on the metal backing plate of the mobile phone integrated with the metal backing plate, an antenna of the mobile phone is unable to operate, and the circuit layout led by the slit on the system board may operate inefficiently.

Accordingly, a significant challenge is related to ways in which to maintain the antenna operation while at the same time optimizing the arrangement of the plastic slots on the metal backing plate associated with designing the antenna integrated with the metal backing plate.

SUMMARY

An aspect of the present disclosure is directed to a multi-band antenna. The multi-band antenna includes a metal backing plate, a radiating conductor, a non-conductor and a connector. The non-conductor is interleaved between the metal backing plate and the radiating conductor. The connector is connected to the metal backing plate and the radiating conductor, and the connector is configured to adjust a connection path between the metal backing plate and the radiating conductor to adjust an antenna operational band.

It is to be, understood that the foregoing general description and the following detailed description are by examples, and are intended to provide further explanation of the invention as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
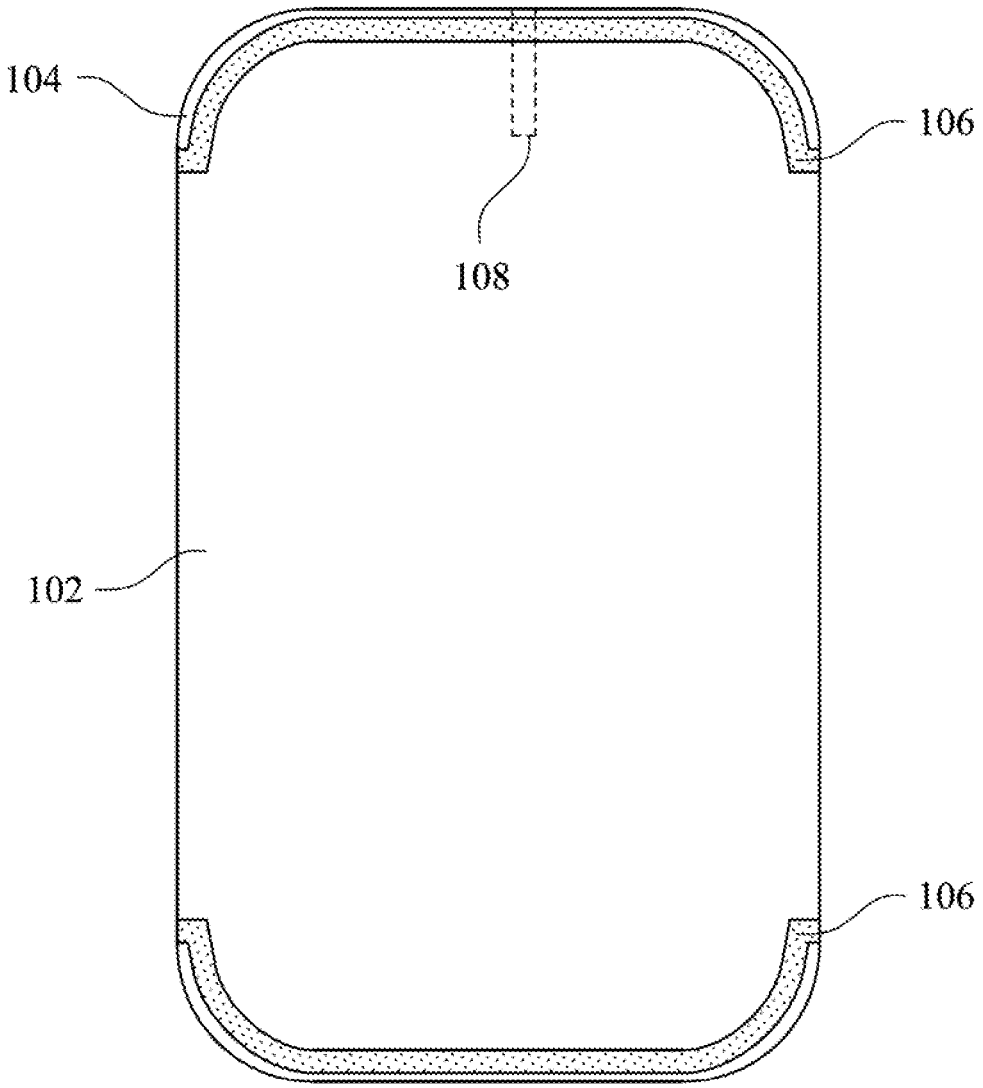
FIG. 1 is a design schematic diagram of a back of a multi-band antenna integrated with a metal backing plate according to some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a design schematic diagram of back of a multi-band antenna integrated with a metal backing plate according to some embodiments of the present disclosure. As shown in FIG. 1, non-conductors 106 are closely connected to the top and the bottom of a metal backing plate 102, and a connector 108 is configured to connect the metal backing plate 102 and a radiating conductor 104. In one embodiment, the connector 108 is a switching connector, and antenna operation band is adjusted according to adjustment of position of the connector 108. It should be noted that, the shape of the connector 108 shown in FIG. 1 is for illustrating, not for limiting the specific structure of the connector 108. The following FIG. 2, FIG. 8, FIG. 13 and FIG. 18 are used to illustrate a variety of aspects of the connector 108.

Figure 2:
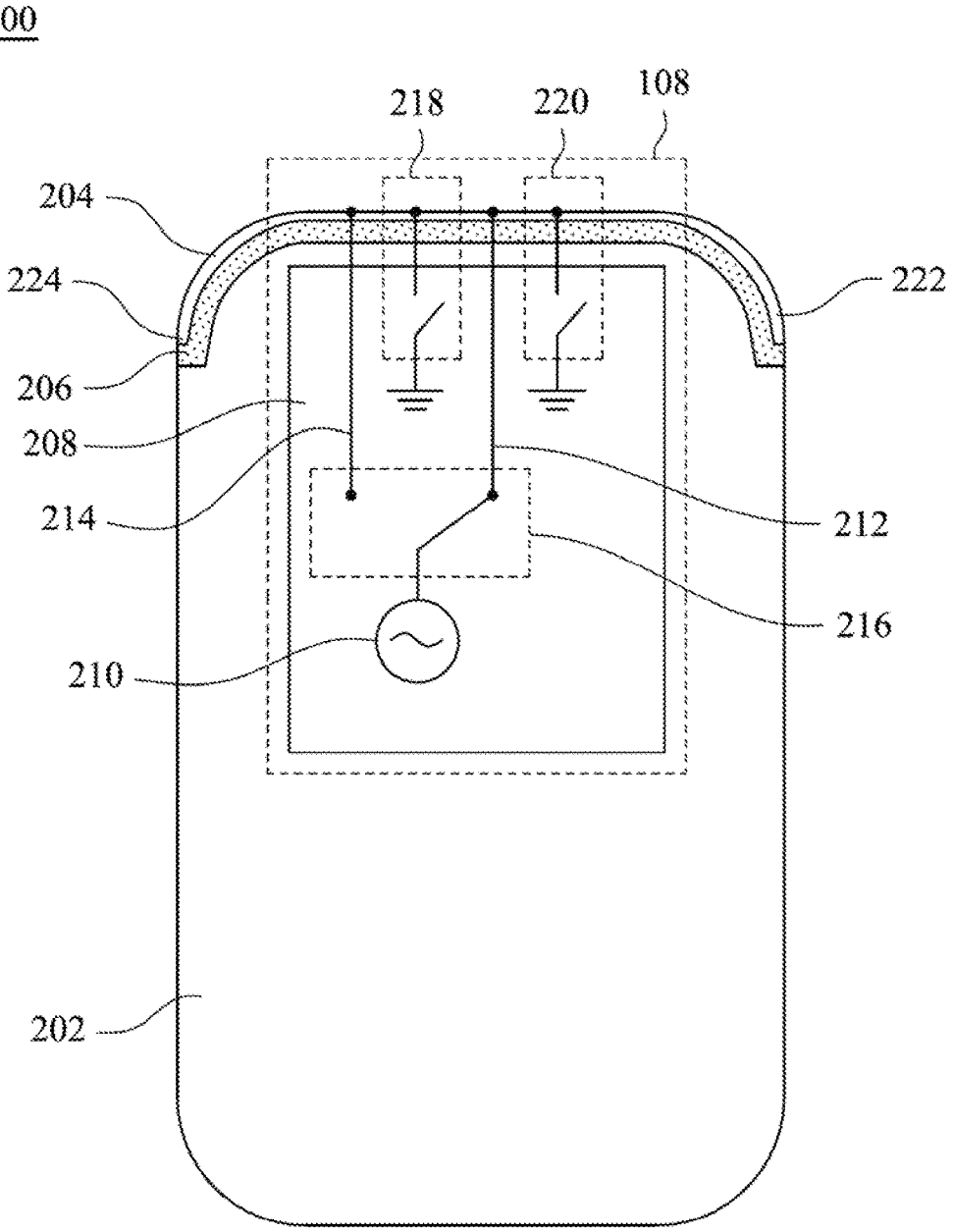
FIG. 2 is a design schematic diagram of a multi-band antenna integrated with a metal backing plate according to a first embodiment of the present disclosure.

FIG. 2 is a design schematic diagram of a multi-band antenna integrated with a metal backing plate according to a first embodiment of the present disclosure. In this embodiment, an antenna structure 200 includes a metal backing plate 202, a radiating conductor 204, a non-conductor 206, a substrate 208, a signal feed-in wire 210, a first metal wire 212, a second metal wire 214, a first switching element 216, a second switching element 218 and a third switching element 220.

The first switching element 216 is a one-to-many port switch (that is, a one-to-two port switch in this embodiment). The signal feed-in wire 210 is connected to one terminal of the first switching element 216, the other terminal of the first switching element 216 can be selectively connected to one terminal of the first metal wire 212 and one terminal of the second metal wire 214, and the other terminals of the first metal wire 212 and the second metal wire 214 are both connected to the radiating conductor 204. Additionally, one terminal of the second switching element 218 and one terminal of the third switching element 220 are respectively connected the radiating conductor 204, and the other terminals of the second switching element 218 and the third switching element 220 are connected to ground. The non-conductor 206 is interleaved between the radiating conductor 204 and the metal backing plate 202. The non-conductor 206 includes materials with different dielectric constants or non-conductive materials, and the non-conductor 206 is mainly configured to support the radiating conductor 204 and the metal backing plate 202.

In the first embodiment of the present disclosure, the metal backing plate 202, the radiating conductor 204, the first metal wire 212 and the second metal wire 214 all include metal elements, carbon fiber elements or any other elements with conductive materials. The signal feed-in wire 210, the first metal wire 212, the second metal wire 214, the first switching element 216, the second switching element 218 and the third switching element 220 are all arranged on the substrate 208. The substrate 208 includes elements with non-conductive materials or materials with different dielectric constants (such as, an epoxy glass fiberboard or a flexible printed circuit board).

In the antenna structure 200 of the first embodiment of the present disclosure, when the first switching element 216 is switched and connected to the first metal wire 212, the second switching element 218 is switched to a short circuit, and the third switching element 220 is switched to an o pen circuit, one terminal of the radiating conductor 204 is an open circuit terminal 222 which is connected to the second switching element 218 via a micro wire with a quarter wavelength to form a short circuit, and there is a signal feed-in point between the open circuit terminal 222 and the second switching element 218. Impedance matching can be achieved by adjusting a distance between the signal feed-in wire 210 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna (PIFA), and energy is passed from the signal feed-in wire 210 to the first metal wire 212 and the radiating conductor 204 to generate a first resonant modal frequency having a lower frequency (that is, a first resonant modal frequency 501 shown in FIG. 5). The first resonant modal frequency is controlled by a path from the open circuit terminal 222 of the radiating conductor 204 to the grounded second switching element 218 which is connected to the radiating conductor 204, and a length of the path equals to a quarter wavelength. When the first resonant modal frequency is generated, a second resonant modal frequency having a higher frequency (that is, a second resonant modal frequency 502 shown in FIG. 5) is generated by a coupling manner, a length of its path is from an open circuit terminal 224 of the radiating conductor 204 to the second switching element 218 which is connected to the open circuit terminal 224 of the radiating conductor 204 via a micro wire with a quarter wavelength to form a shorter circuit, and the length of its path equals to a quarter wavelength.

When the first switching element 216 is switched and connected to the first metal wire 212, the second switching element 218 is switched to an open circuit, and the third switching element 220 is switched to a short circuit, one terminal of the radiating conductor 204 is the open circuit terminal 224 which is connected to the third switching element 220 via a micro wire with a quarter wavelength to form a short circuit, and there is a signal feed-in point between the open circuit terminal 222 and third switching element 220. Impedance matching can be achieved by adjusting a distance between the signal feed-in wire 210 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from signal feed-in wire 210 to the first metal wire 212 and the radiating conductor 204 to generate a third resonant modal frequency having a higher frequency (that is, a third resonant modal frequency 503 shown in FIG. 5). The third resonant modal frequency is controlled by a path from the open circuit terminal 204 of the radiating conductor 204 to the grounded third switching element 220 which is connected to the radiating conductor 204, and a length of the path equals to a quarter wavelength. When the third resonant modal frequency is generated, a fourth resonant modal frequency having a lower frequency (that is a fourth resonant modal frequency 504 shown in FIG. 5) is generated by a coupling manner, a length of its path is from the open circuit terminal 222 of the radiating conductor 204 to the third switching element 220 which is connected to the open circuit terminal 222 of the radiating conductor 204 via a micro wire with a quarter wavelength to form a shorter circuit, and the length of its path equals to a quarter wavelength.

When the first switching element 216 i switched and connected to the second metal wire 214, the second switching element 218 is switched to a short circuit, and the third switching element 220 is switched to an open circuit, one terminal of the radiating conductor 204 is the open circuit terminal 224 which is connected to the second switching element 218 via a micro wire with a quarter wavelength to form a short circuit, and there is a signal feed-in point between the open circuit terminal 224 and the second switching element 218. Impedance matching can be achieved by adjusting a distance between the signal feed-in 210 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from the signal feed-in wire 210 to the second metal wire 214 and the radiating conductor 204 to generate a fifth resonant modal frequency having a higher frequency (that is, a fifth resonant modal frequency 601 shown in FIG. 6). The fifth resonant modal frequency is controlled by a path from the open circuit terminal 224 of the radiating conductor 204 to the grounded second switching element 218 which is connected to the radiating conductor 204, and a length of the path equals to a quarter wavelength. When the fifth resonant modal frequency is generated, a sixth resonant modal frequency having a lower frequency (that is, a sixth resonant modal frequency 602 shown in FIG. 6), a length of its path is from the open circuit terminal 222 of the radiating conductor 204 to the second switching element 218 which is connected to the open circuit terminal 222 of the radiating conductor 204 via a micro wire with a quarter wavelength to form a shorter circuit, and the length of its path equals to a quarter wavelength.

When the first switching element 216 is switched and connected to the second metal wire 214, the second switching element 218 is switched to an open circuit, and the third switching element 220 is switched to a short circuit, one terminal of the radiating conductor 204 is the open circuit terminal 224 which is connected to the third switching element 220 via a micro wire with a quarter wavelength to form a short circuit, and there is a signal feed-in point between the open circuit terminal 224 and the third switching element 220. Impedance matching can be achieved by adjusting a distance between the signal feed-in wire 210 and a short circuit to find signal feed-in resonant point resistance 50 Ω, and reactance should be close to zero. Therefore, the perfect impedance matching can be achieved, and electromagnetic radiation is triggered to transmit signals. The antenna structure is a planar inverted-F antenna, and energy is passed from the signal feed-in wire 210 to the second metal wire 214 and the radiating conductor 204 to generate a seventh resonant modal frequency having a higher frequency (that is, a seventh resonant model frequency 603 shown in FIG. 6). The seventh resonant model frequency is controlled by a path from the open circuit terminal 224 of the radiating conductor 204 to the grounded third switching element 220 which is connected to the radiating conductor 204, and a length of the path equals to a quarter wavelength. When the seventh resonant model frequency is generated, an eighth resonant model frequency having a lower frequency (that is, an eighth resonant model frequency 604 shown in FIG. 6) is generated by a coupling manner, a length of its path is from the open circuit terminal 222 of the radiating conductor 204 to the third switching element 220 which is connected to the open circuit terminal 222 of the radiating conductor 204 via a micro wire with a quarter wavelength to form a shorter circuit, and the length of its path equals to a quarter wavelength. The multi-band antenna integrated with the metal backing plate can obtain eight resonant modal frequencies.

Figure 3:
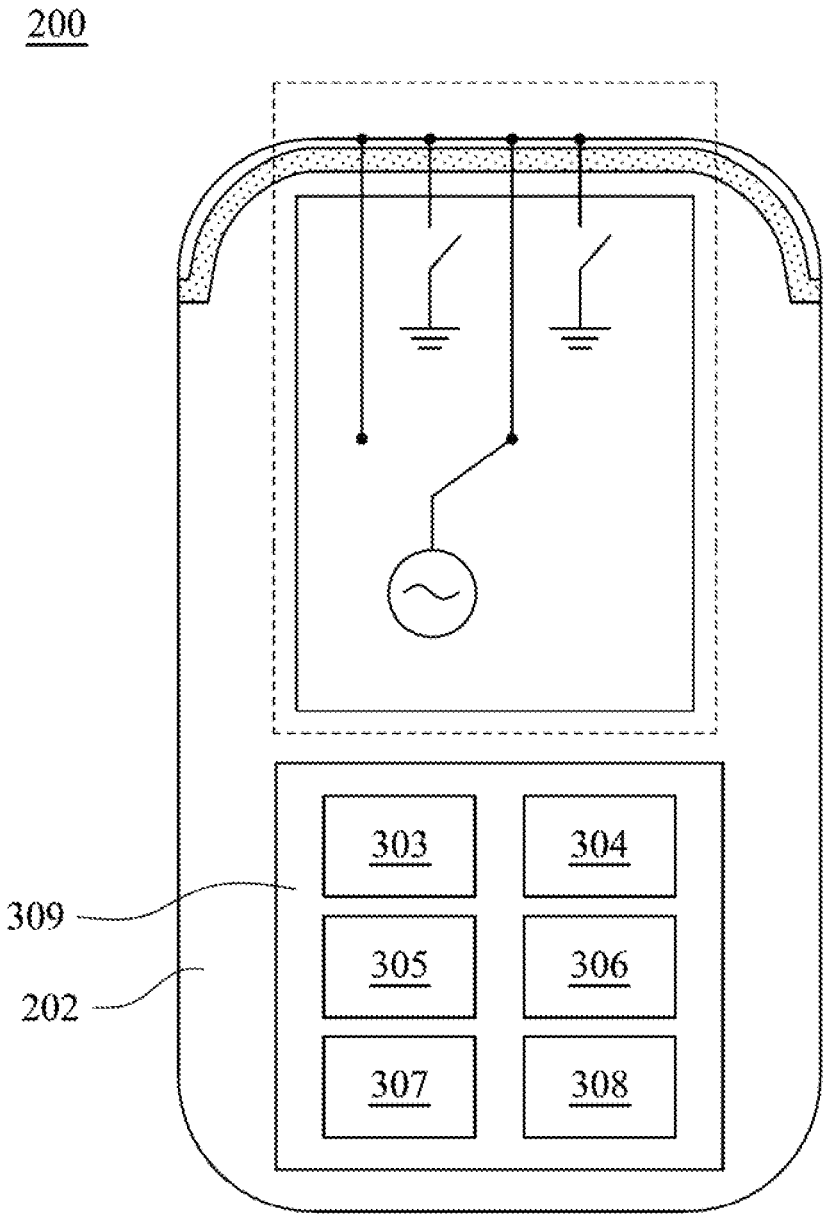
FIG. 3 is a design schematic diagram of the multi-band antenna, integrated with the metal backing plate according to the first embodiment of the present disclosure.

FIG. 3 is a design schematic diagram of the multi-band antenna integrated with the metal backing plate according to the first embodiment of the present disclosure. The multi-band antenna structure 200 in the specific embodiment of the present disclosure is integrated with the metal backing plate. The metal backing plate 202 includes one or more substrates 309, and the substrate 309 is connected to the metal backing plate 202 via elastic pieces or elements with conductive materials. The substrate 309 includes a liquid-crystal display module (LCM) 303, a radio frequency module 304, a baseband module 305, a central processing unit (CPU) module 306, a memory 307, a camera module 308 and any other function modules.

Figure 4A:
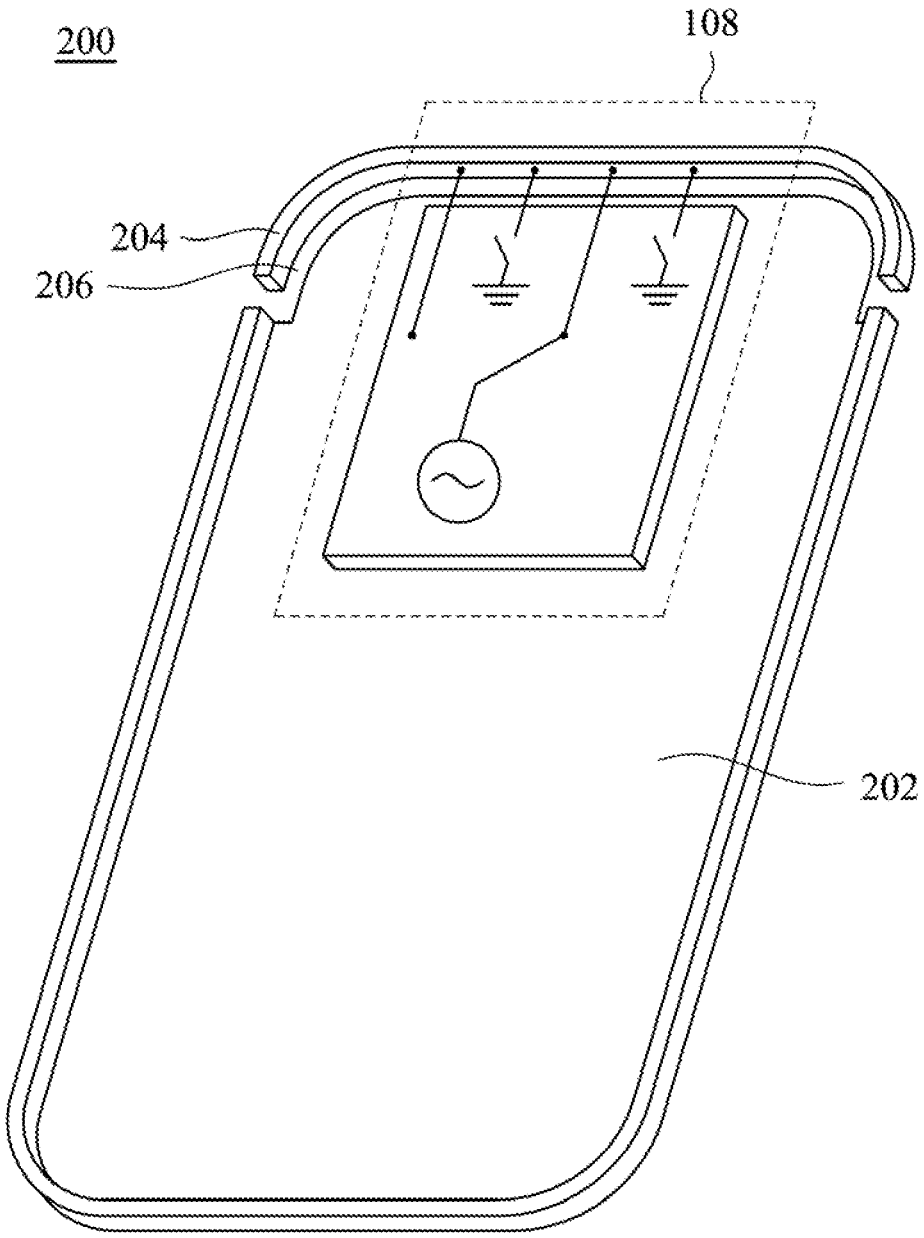
FIG. 4A and FIG. 4B are three-dimensional design schematic diagrams of the multi-band antenna integrated with the metal backing plate according to the first embodiment of the present disclosure.
Figure 4B:
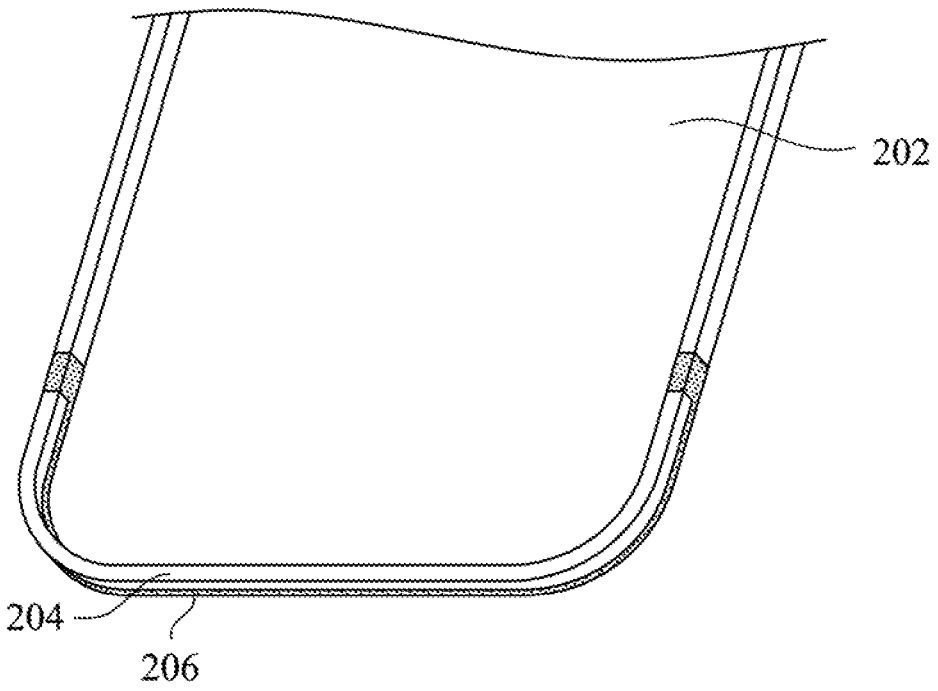

FIG. 4A and FIG. 4B are three-dimensional design schematic diagrams of the multi-band antenna integrated with the metal backing plate according to the first embodiment of the present disclosure. As shown in FIG. 4A and FIG. 4B, in the antenna structure 200, the non-conductor 206 is interleaved between the radiating conductor 204 arid the metal backing plate 202, and the non-conductor 206 is configured to connect the radiating conductor 204 and the metal backing plate 202. The non-conductor 206 is mainly configured to support the radiating conductor 204 and the metal backing plate 202.

Figure 5:
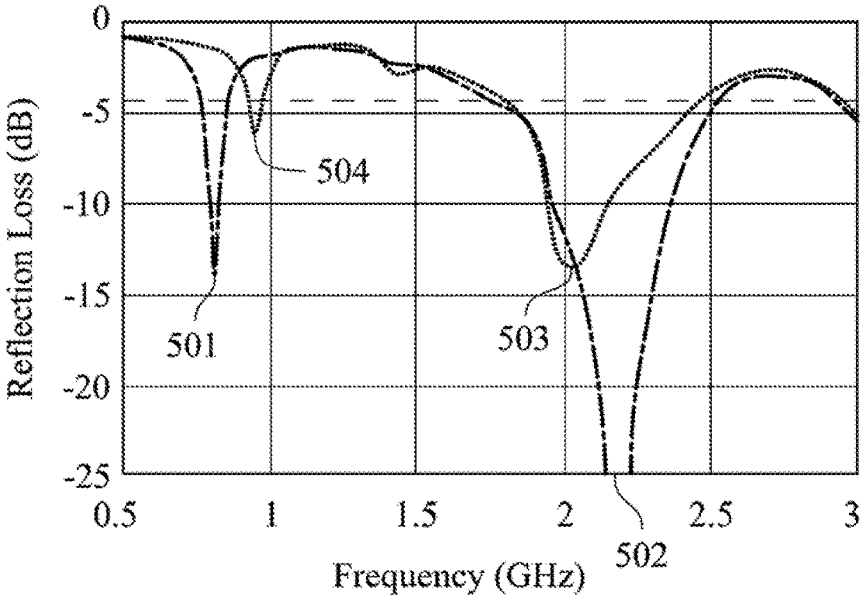
FIG. 5 is an operation reflection loss diagram of a first resonant modal frequency, a second resonant modal frequency, a third resonant modal frequency and a fourth resonant modal frequency according to one operation mode of the first embodiment of the present disclosure.

FIG. 5 is an operation reflection loss diagram of a first resonant modal frequency, a second resonant modal frequency, a third resonant modal frequency and a fourth resonant modal frequency according to one operation mode of the first embodiment of the present disclosure. As shown in FIG. 5, the antenna structure 200 has the first resonant modal frequency 501, the second resonant modal frequency 502, the third resonant modal frequency 503 and the fourth resonant modal frequency 504. A voltage standing wave ratio (VSWR) having a ratio of 4.5:1 or a 4 dB reflection loss can be used as a standard of input impedance bandwidth. The impedance bandwidth of operation frequencies includes bandwidths required from communication bands of the code division multiple, access 2000 (CDMA2000) the enhanced general packet radio service (EGPRS), the universal telecommunication system (UMTS) and the long term evolution (LTE) system.

Figure 6:
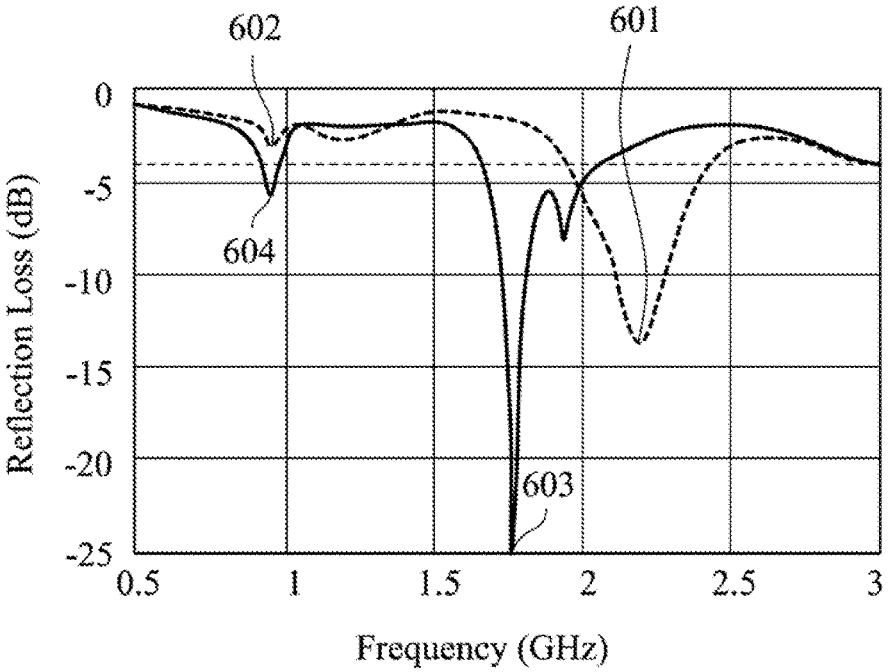
FIG. 6 is an operation reflection loss diagram of a fifth resonant modal frequency, a sixth resonant modal frequency, a seventh resonant modal frequency and an eighth resonant modal frequency according to the other operation mode of the first embodiment of the present disclosure.

FIG. 6 is an operation reflection loss diagram of a fifth resonant modal frequency, a sixth resonant modal frequency, a seventh resonant modal frequency and an eighth resonant modal frequency according to the other operation mode of the first embodiment of the present disclosure. As shown in FIG. 6, the antenna structure 200 has the fifth resonant modal frequency 601, the sixth resonant modal frequency 602, the seventh resonant modal frequency 603 and the eighth resonant modal frequency 604. A voltage standing wave ratio having a ratio of 4.5:1 or a 4 dB reflection loss can be used as a standard of input impedance bandwidth. The impedance bandwidth of operation frequencies includes bandwidths required from communication bands of the code division multiple access 2000, the enhanced general packet radio service, the universal telecommunication system and the long term evolution system.

Figure 7:
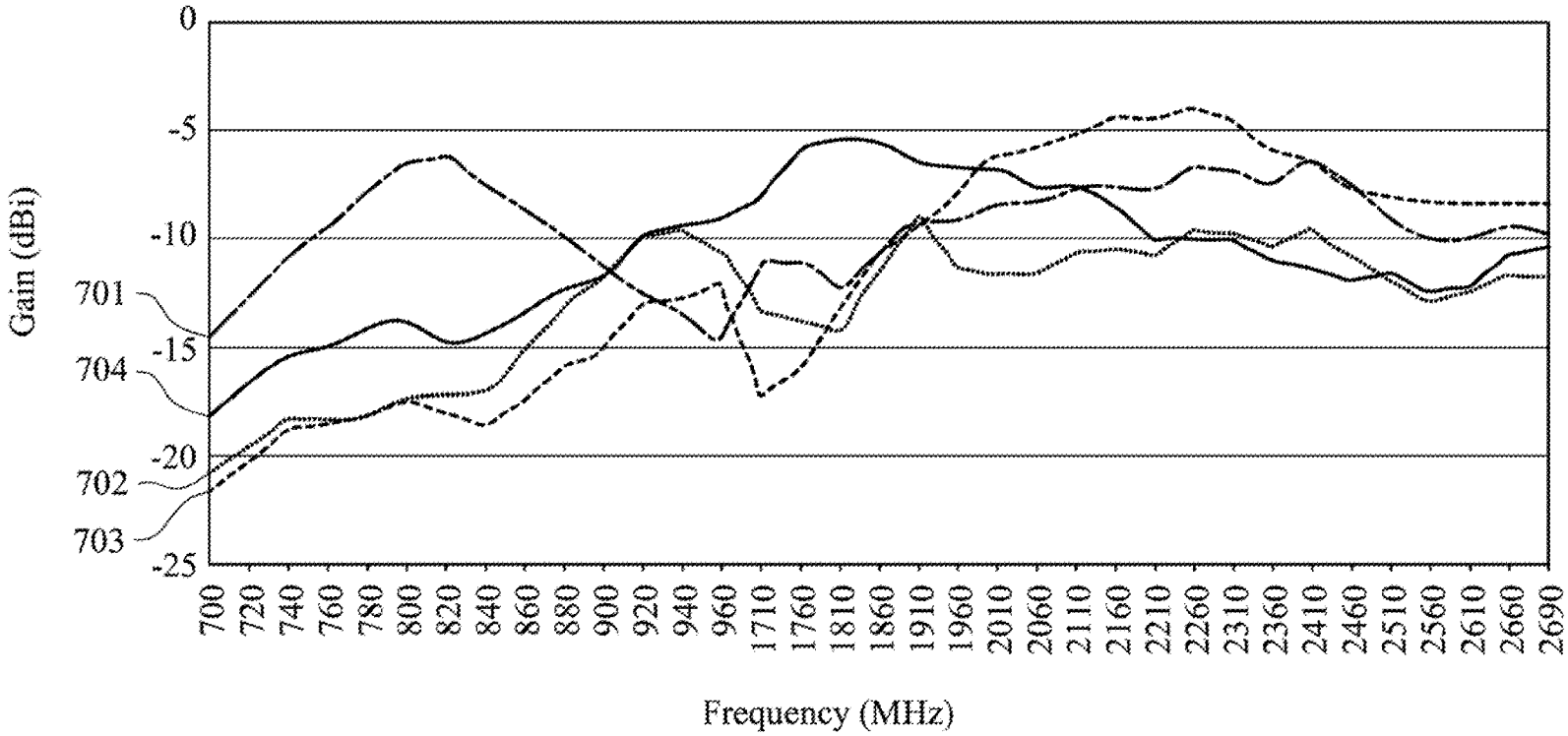
FIG. 7 is an operation modal gain diagram of the multi-band antenna integrated with the metal backing plate according to the first embodiment of the present disclosure.

FIG. 7 is an operation modal gain diagram of the multi-band antenna integrated with the metal backing plate according to the first embodiment of the present disclosure. As shown in FIG. 7, a curve 701, a curve 702, a curve 703 and a curve 704 respectively represent antenna operation modal gains of the first resonant modal frequency 501 and the second resonant modal frequency 502, the third resonant modal frequency 503 and the fourth resonant modal frequency 504, the fifth resonant modal frequency 601 and the sixth resonant modal frequency 602, the seventh resonant modal frequency 603 and the eighth resonant modal frequency 604.

Figure 8:
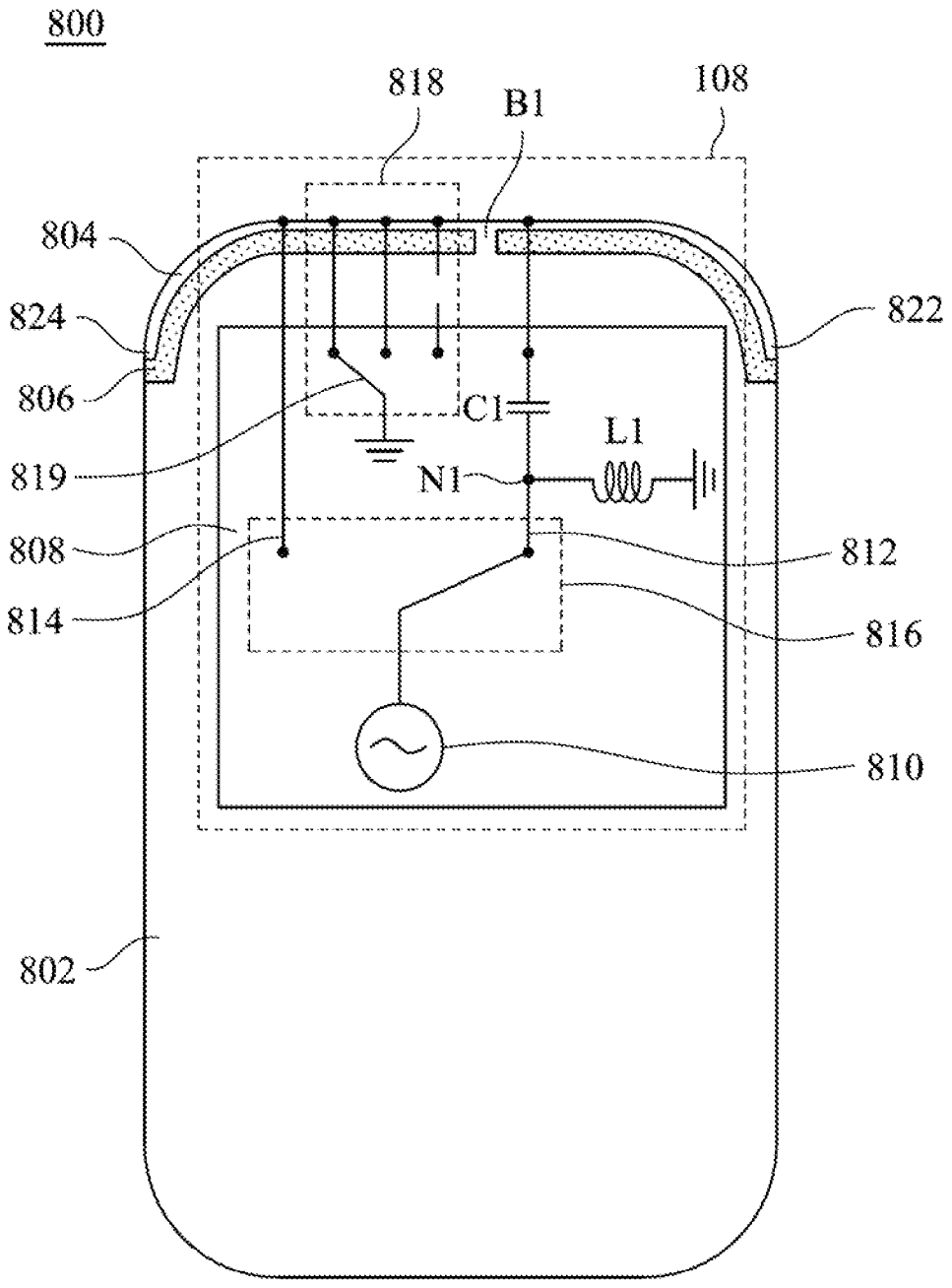
FIG. 8 is a design schematic diagram of a multi-band antenna integrated with a metal backing plate according to a second embodiment of the present disclosure.

FIG. 8 is a design schematic diagram of a multi-band antenna integrated with a metal backing plate according to a second embodiment of the present disclosure. In this embodiment, an antenna structure 800 includes a metal backing plate 802, a radiating conductor 804, a non-conductor 806, a substrate 808, a signal feed-in wire 810, a first metal wire 812, a second metal wire 814, a first switching element 816 and a second switching element 818.

The first switching element 816 is a one-to-many port switch (that is, a one-to-two port switch in this embodiment). The signal feed-in wire 810 is connected to one terminal of the first switching element 816, and the other terminal of the first switching element 816 can be selectively connected to one terminal of the first metal wire 812 and one terminal of the second metal wire 814. The other terminal of the first metal wire 812 is divided at a node N1, and the other terminal of the first metal wire 812 is connected to the radiating conductor 804 via a capacitor C1 and connected to ground via an inductor L1. The other terminal of the second metal wire 814 is connected to the radiating conductor 804. Additionally, the second switching element 818 is a one-to-many port switch 819 (that is, a one-to-three port switch in this embodiment). One terminal of the second switching element 818 can be connected to the radiating conductor 804 selectively via a first port and a second port, a third port is an open circuit, and the other terminal of the second switching element 818 is connected to ground. The non-conductor 806 is interleaved between the radiating conductor 804 and the metal backing plate 802, and the non-conductor 806 has a breakpoint B1 dividing the non-conductor 806 into two regions. The metal backing plate 802 is connected to the radiating conductor 804 via the breakpoint B1. The non-conductor 806 includes materials with different dielectric constants or non-conductive materials, and the non-conductor 806 is mainly configured to support the radiating conductor 804 and the metal backing plate 802.

In the second embodiment of the present disclosure, the metal backing plate 802, t he radiating conductor 804, t he first metal wire 812 and the second metal wire 814 all include metal elements, carbon fiber elements or any other elements with conductive materials. The signal feed-in wire 810, first metal wire 812, the second metal wire 814 the first switching element 816 and the second switching element 818 are all arranged on the substrate 808. The substrate 808 includes elements with non-conductive materials or materials with different dielectric constants (such as, an epoxy glass fiberboard or a flexible printed circuit board).

In the antenna structure 800 of the second embodiment of the present disclosure, when the first switching element 816 is switched and connected to the first metal wire 812, one terminal of the radiating conductor 804 is an open circuit terminal 822 which is connected to the breakpoint B1 via a micro wire with a quarter wavelength to form a short circuit, and there is a signal feed-in point between the open circuit 822 and the breakpoint B1. Impedance matching can be achieved by adjusting a distance between the signal feed-in wire 810 and a short circuit and matching the reactance (that is, the capacitor C1 and the inductor L1) to find signal feed-in resonant point resistance 50Ω, and the reactance should be close to zero. Therefore, the perfect impedance matching can be achieved, and electromagnetic radiation is triggered to transmit signals. The antenna structure is a planar inverted-F antenna, and energy is passed from the signal feed-in wire 810 to the first metal wire 812 and the radiating conductor 804 to generate a first resonant modal frequency having a lower frequency (that is, a first resonant modal frequency 901 shown in FIG. 9).

When the first switching element 816 is switched and connected to the second metal wire 814, and the second switching element 818 is switched to a short circuit via the first port, one terminal of the radiating conductor 804 is an open circuit terminal 824 which is connected to the second switching element 818 via a micro wire with a quarter wavelength to form a short circuit, and there is a signal feed-in point between the open circuit terminal 824 and the second switching element 818. Impedance matching can be achieved by adjusting a distance between the signal feed-in wire 810 and a short circuit to find signal feed-in resonant point resistance 50Ω, and reactance should be close to zero. Therefore, the perfect impedance matching can be achieved, and electromagnetic radiation is triggered to transmit signals. The antenna structure is planar inverted-F antenna, and energy is passed from the signal feed-in wire 810 to the second metal wire 814 and the radiating conductor 804 to generate a second resonant modal frequency having a higher frequency (that is, a second resonant modal frequency 1101 shown in FIG. 11). The second resonant modal frequency is controlled by a path from the open circuit 824 of the radiating conductor 804 to the grounded second switching element 818 which is connected the radiating conductor 804, and a length of the path equals to a quarter wavelength.

When the first switching element 816 is switched and connected to the second metal wire 814, and the second switching element 818 is switched to a short circuit via the second port, one terminal of the radiating conductor 804 is the open circuit terminal 824 which is connected to the second switching element 818 via a micro wire with a quarter wavelength to form a shorter circuit, and there is a signal feed-in point between the open circuit terminal 824 and the second switching element 818. Impedance matching can be achieved by adjusting a distance between signal feed-in wire 810 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from the signal feed-in re 810 to the second metal wire 814 and the radiating conductor 804 to generate a third resonant modal frequency having a higher frequency (that is, a third resonant modal frequency 1102 shown in FIG. 11). The third resonant modal frequency is controlled by a path from the open circuit 824 of the radiating conductor 804 to the grounded second switching element 818 which is connected to the radiating conductor 804 and, a length of the path equals to a quarter wavelength.

When the first switching element 816 is switched and connected to the second metal wire 814, and the second switching element 818 is switched to an open circuit via the third port, one terminal of the radiating conductor 804 is the open circuit terminal 824 which is connected to the breakpoint B1 via a micro wire with a quarter wavelength to form a shorter circuit, and there is a signal feed-in point between the open circuit terminal 824 and the breakpoint B1. Impedance matching can be achieved by adjusting a distance between the signal feed-in wire 810 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from the signal feed-in wire 810 to the second metal wire 814 and the radiating conductor 804 to generate a fourth resonant modal frequency having a higher frequency (that is, a fourth resonant modal frequency 1103 shown in FIG. 11). The multi-band antenna integrated with the metal backing plate can obtain four resonant modal frequencies.

In this embodiment, the metal backing plate can be integrated with one or more substrates, and integration manners of the substrates and functions of the substrates are similar to the first embodiment illustrated previously. Additionally, in this embodiment, a relationship of three-dimensional integration among the metal backing plate, the radiating conductor and the non-conductor is also similar to the first embodiment illustrated previously, so will not be repeated.

Figure 9:
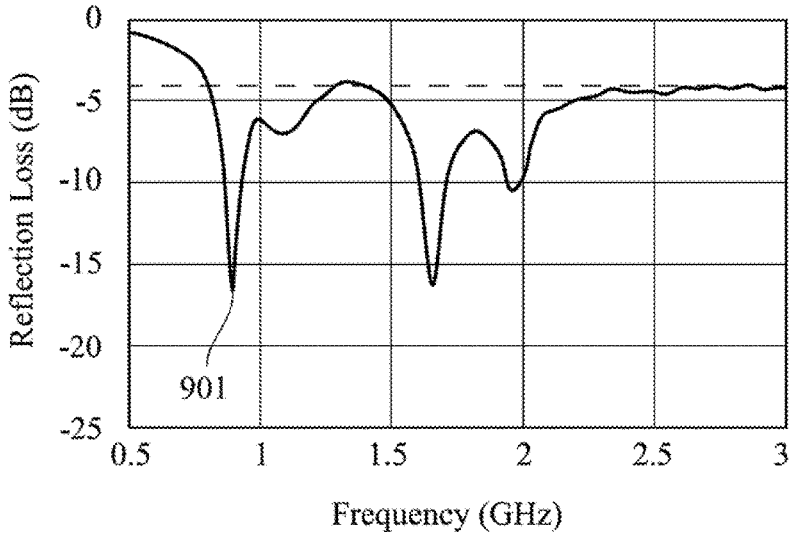
FIG. 9 is an operation reflection loss diagram of a first resonant modal frequency according to one operation mode of the second embodiment of the present disclosure.

FIG. 9 is an operation reflection loss diagram of a first resonant modal frequency according to one operation mode of the second embodiment of the present disclosure. As shown in FIG. 9, the antenna structure 800 has the first resonant modal frequency 901. A voltage standing wave ratio having a ratio of 4.5:1 or a 4 dB reflection loss can be used as a standard of input impedance bandwidth. The impedance bandwidth of operation frequencies includes bandwidths required from communication bands of the code division multiple access 2000, the enhanced general packet radio service, the universal telecommunication system and the long term evolution system.

Figure 10:
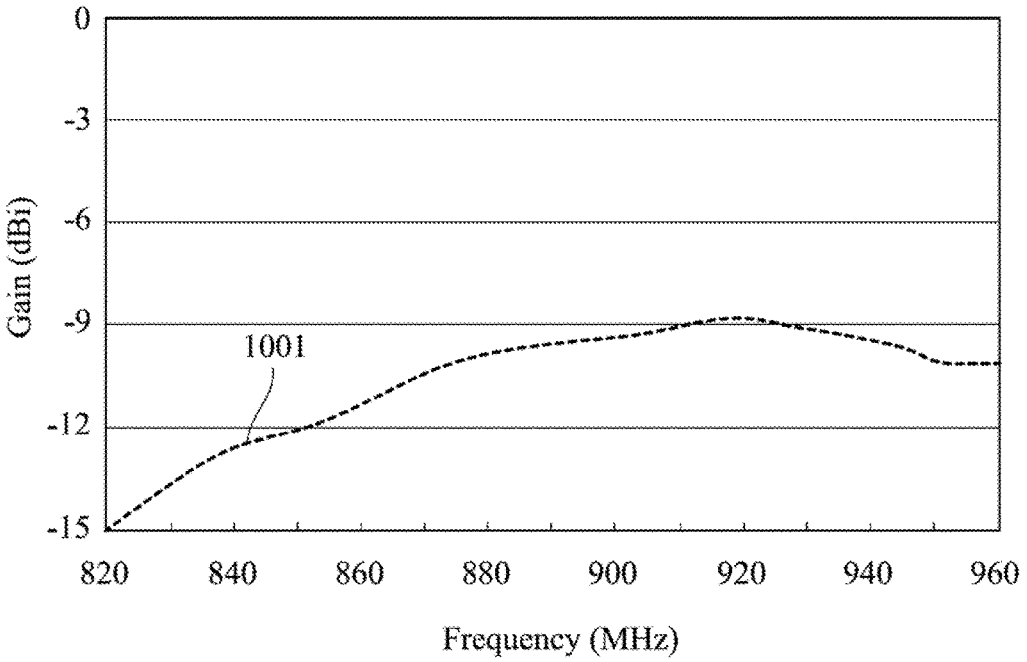
FIG. 10 is an operation modal gain diagram of the multi-band antenna integrated with the metal backing plate according to one operation mode of the second embodiment of the present disclosure.

FIG. 10 is an operation modal gain diagram of the multi-band antenna integrated with the metal backing plate according to one operation mode of the second embodiment of the present disclosure. As shown in FIG. 10, a curve 1001 represents an antenna operation modal gain of the first resonant modal frequency 901.

Figure 11:
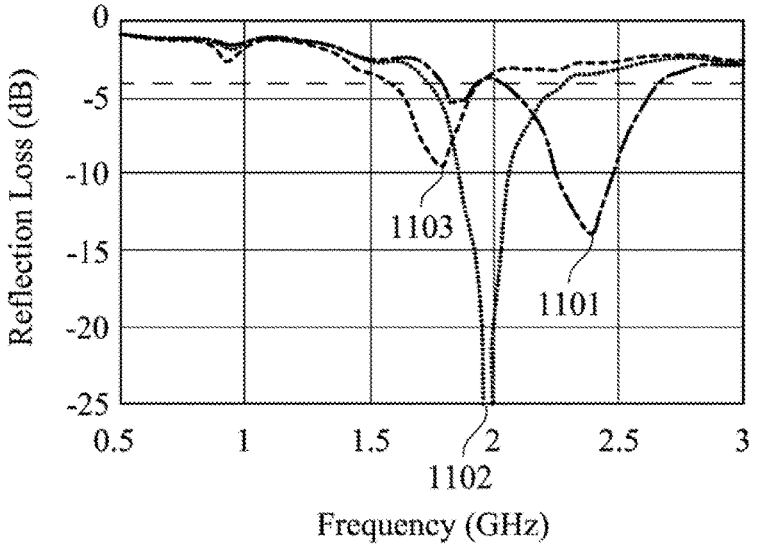
FIG. 11 is an operation reflection loss diagram of a second resonant modal frequency, a third resonant modal frequency and a fourth resonant modal frequency according to the other operation mode of the second embodiment of the present disclosure.

FIG. 11 is an operation reflection loss diagram of a second resonant modal frequency, a third resonant modal frequency and a fourth resonant modal frequency according to the other operation mode of the second embodiment of the present disclosure. As shown in FIG. 11, the antenna structure 800 has the second resonant modal frequency 1101, the third resonant modal frequency 1102 and the fourth resonant modal frequency 1103. A voltage standing wave ratio having a ratio of 4.5:1 or a 4 dB reflection loss can be used as a standard of input impedance bandwidth. The impedance bandwidth of operation frequencies includes bandwidths required from communication bands of the code division multiple access 2000, the enhanced general packet radio service, the universal telecommunication system and the long term evolution system.

Figure 12:
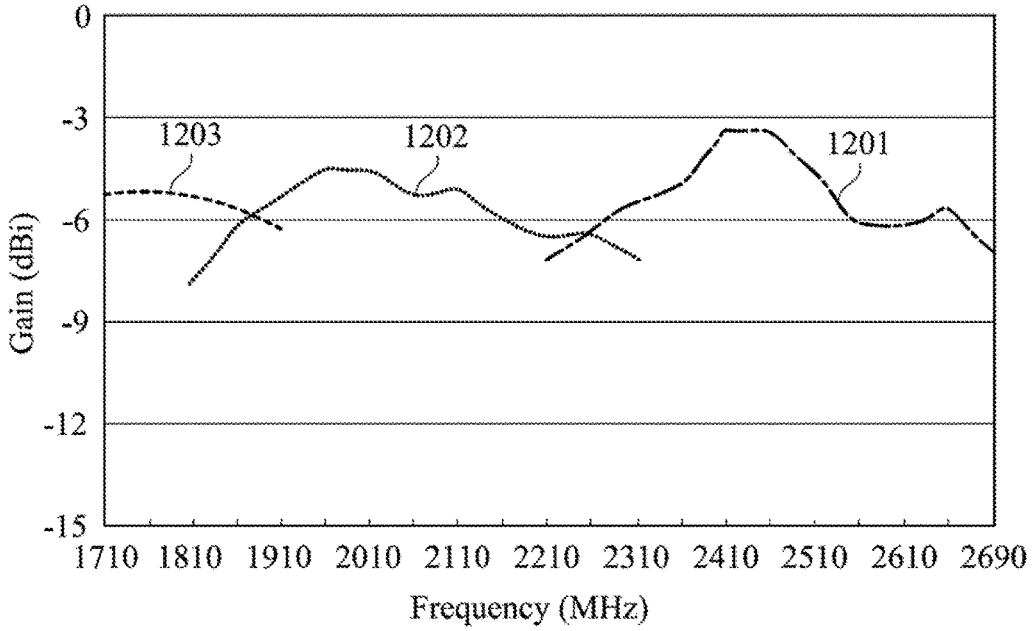
FIG. 12 is an operation modal gain diagram of the multi-band antenna integrated with the metal backing plate according to the other operation mode of the second embodiment of the present disclosure.

FIG. 12 is an operation modal gain diagram of the multi-band antenna integrated with the metal backing plate according to the other operation mode of the second embodiment of the present disclosure. As shown in FIG. 12, a curve 1201, a curve 1202 and a curve 1203 respectively represent antenna operation modal gains of the second resonant modal frequency 1101, the third resonant modal frequency 1102 and the fourth resonant modal frequency 1103.

Figure 13:
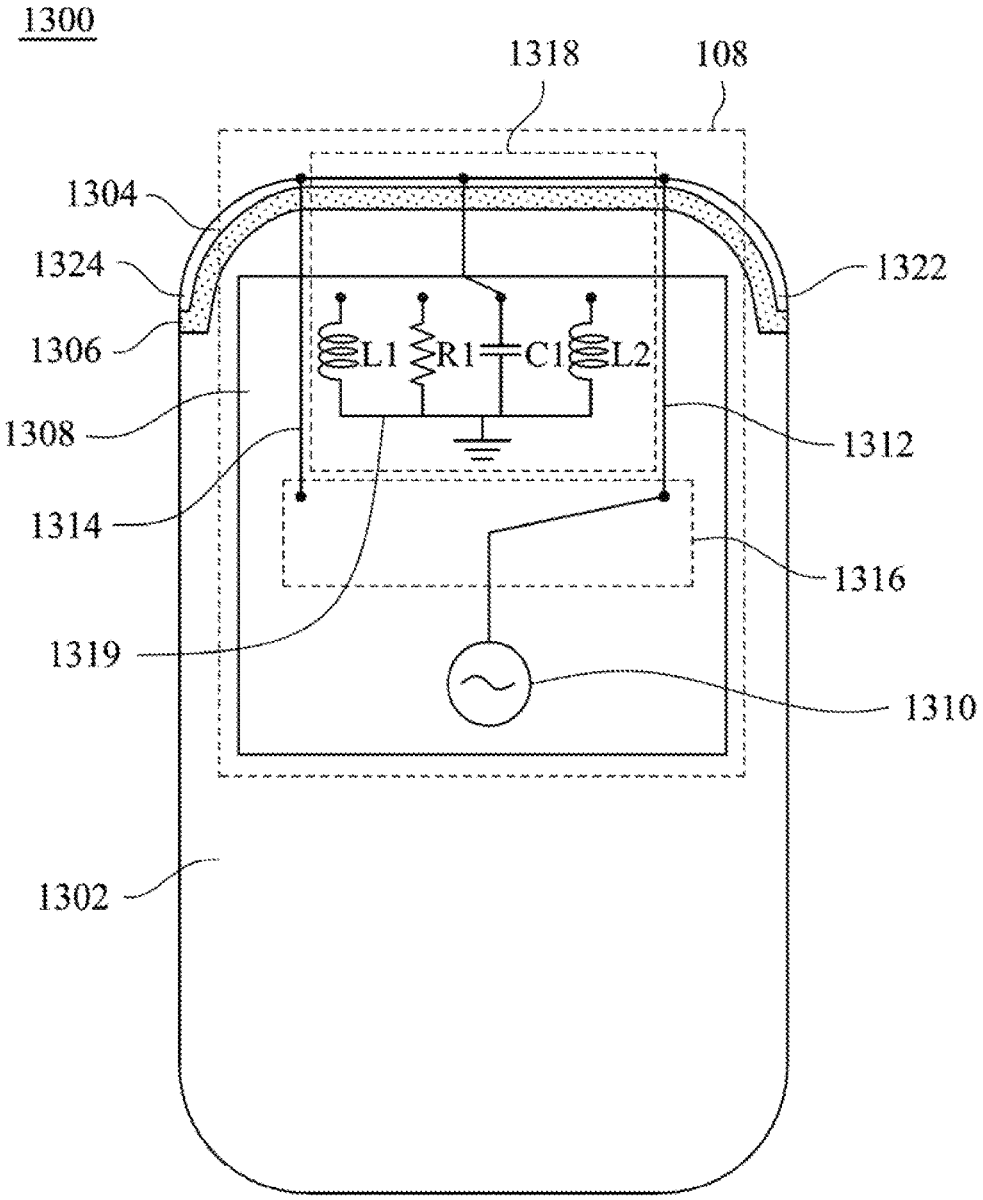
FIG. 13 is a design schematic diagram of a multi-band antenna integrated with a metal backing plate according to a third embodiment of the present disclosure.

FIG. 13 is a design schematic diagram of a multi-band antenna integrated with a metal backing plate according to a third embodiment of the present disclosure. In this embodiment, an antenna structure 1300 includes a metal backing plate 1302, a radiating conductor 1304, a non-conductor 1306, a substrate 1308, a signal feed-in wire 1310, a first metal wire 1312, a second metal wire 1314, a first switching element 1316 and a second switching element 1318.

The first switching element 1316 is a one-to-many port switch (that is, a one-to-two port switch in this embodiment). The signal feed-in wire 1310 is connected to one terminal of the first switching element 1316, the other terminal of the first switching element 1316 can be selectively connected to one terminal of the first metal wire 1312 and one terminal of the second metal wire 1314, and the other terminals of the first metal wire 1312 and the second metal wire 1314 are both connected to the radiating conductor 1304. The second switching element 1318 is a one-to-many port switch 1319 (that is, one-to-four port switch in this embodiment). One terminal of the second switching element 1318 can be connected to ground selectively via a first port coupled to a first inductor L1, a second port coupled to a resistor R1, a third port coupled to a capacitor C1 and a fourth port coupled to a second inductor L2, and the other terminal of the second switching element 1318 is connected to the radiating conductor 1304. The inductance of the first inductor L1 is approximately larger than that of the second inductor L2. The non-conductor 1306 is interleaved between the radiating conductor 1304 and the metal backing plate 1302. The non-conductor 1306 includes materials with different dielectric constants or non-conductive materials, and the non-conductor 1306 is mainly configured to support the radiating conductor 1304 and the metal backing plate 1302.

In the third embodiment of the present disclosure, the metal backing plate 1302, the radiating conductor 1304, the first metal wire 1312 and the second metal wire 1314 all include metal elements, carbon fiber elements or any other elements with conductive materials. The signal feed-in wire 1310, the first metal wire 1312, the second metal wire 1314, the first switching element 1316 and the second switching element 1318 are all arranged on the substrate 1308. The substrate 1308 includes elements with non-conductive materials or materials with different dielectric constants (such as, an epoxy glass fiberboard or a flexible printed circuit board).

In the antenna structure 1300 of the third embodiment of the present disclosure, when the first switching element 1316 is switched and connected to the first metal wire 1312, and the second switching element 1318 is switched to a short circuit via the second port (that is, via the resistor R1), one terminal of the radiating conductor 1304 is an open circuit terminal 1322 which is connected to the second switching element 1318 via a micro wire with a quarter wavelength to form a short circuit, and there is a signal feed-in point between the open circuit terminal 1322 and the second switching element 1318. Impedance matching can be achieved by adjusting a distance between the signal feed-in wire 1310 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from the signal feed-in wire 1310 to the first metal wire 1312 and the radiating conductor 1304 to generate a resonant modal frequency having a lower frequency (that is, a first resonant modal frequency 1401 shown in FIG. 14). The first resonant modal frequency is controlled by a path from the open circuit terminal 1322 of the radiating conductor 1304 to the grounded second switching element 1318 which is connected to the radiating conductor 1304, and a length of the path equals to a quarter wavelength. When the first resonant modal frequency is generated, a second resonant modal frequency having a higher frequency is generated by a coupling manner (that is, a second resonant modal frequency 1402 shown in FIG. 14), a length of its path is from an open circuit terminal 1324 of the radiating conductor 1304 to the second switching element 1318 which is connected to the open circuit 1324 of the radiating conductor 1304 via a micro wire with a quarter wavelength to form a shorter circuit, and the length of its path equals to a quarter wavelength.

When the first switching element 1316 is switched and connected to the first metal wire 1312, and the second switching element 1318 is switched to a short circuit via the fourth port (that is, via the second inductor L2), one terminal of the radiating conductor 1304 is the open circuit terminal 1322 which is connected to the second switching element 1318 via a micro wire with a quarter wavelength to form a shorter circuit, and there is a signal feed-in point between the open circuit terminal 1322 and the second switching element 1318. Impedance matching can be achieved by adjusting a distance between the signal feed-in wire 1310 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from the signal feed-in wire 1310 to the first metal wire 1312 and the radiating conductor 1304 to generate a third resonant modal frequency having a lower frequency (that is, a third resonant modal frequency 1403 shown in FIG. 14). The third resonant modal frequency is controlled by a path from the open circuit terminal 1322 of the radiating conductor 1304 to the grounded second switching element 1318 which is connected to the radiating conductor 1304, and the length of the path is a quarter wavelength. When the third resonant modal frequency is generated, a fourth resonant modal frequency having a higher frequency (that is, a fourth resonant modal frequency 1404 shown in FIG. 14) is generated by a coupling manner, a length of its path is from the open circuit terminal 1324 of the radiating conductor 1304 to the second switching element 1318 which is connected to the open circuit terminal 1324 of the radiating conductor 1304 via a micro wire with a quarter wavelength to form a shorter circuit, and the length of its path equals to a quarter wavelength.

When the first switching element 1316 is switched and connected to the first metal wire 1312, and the second switching element 1318 is switched to a short circuit via the first port (that is, via the first inductor L1), one terminal of the radiating conductor 1304 is the open circuit terminal 1322 which is connected to the second switching element 1318 via a micro wire with a quarter wavelength to form a short circuit, and there is a signal feed-in point between the open circuit terminal 1322 and the second switching element 1318. Impedance matching can be achieved by adjusting a distance between the signal feed-in wire 1310 and a shorter circuit to find signal feed-in resonant point resistance 50Ω, and reactance should be close to zero. Therefore, perfect impedance matching can be achieved, and electromagnetic radiation is triggered to transmitted signals. The antenna structure is a planar inverted-F antenna, and energy is passed from the signal feed-in wire 1310 to the first metal wire 1312 and the radiating conductor 1304 to generate a fifth resonant modal frequency having a lower frequency (that is, a fifth resonant modal frequency 1405 shown in FIG. 14). The fifth resonant modal frequency is controlled by a path from the open circuit terminal 1322 of the radiating conductor 1304 to the grounded second switching element 1318 which is connected to the radiating conductor 1304 and a length of the path is a quarter wavelength. When the fifth resonant modal frequency is generated, a sixth resonant modal frequency having a higher frequency (that is, a sixth resonant modal frequency 1406 shown in FIG. 14) is generated by a coupling manner, a length of its path is from the open circuit terminal 1324 of the radiating conductor 1304 to the second switching element 1318 which is connected to the open circuit terminal 1324 of the radiating conductor 1304 via a micro wire with a quarter wavelength to form a shorter circuit, and the length of its path equals to a quarter wavelength.

When the first switching element 1316 is switched and connected to the second metal wire 1314, and the second switching element 1318 is switched to a short circuit via the third port (that is, via the capacitor C1), one terminal of the radiating conductor 1304 is the open circuit terminal 1324 which is connected to the second switching element 1318 via a micro wire with a quarter wavelength to form a short circuit, and there is a signal feed-in point between the open circuit terminal 1324 and the second switching element 1318. Impedance matching can be achieved by adjusting a distance between the signal feed-in wire 1310 and a short circuit to find signal feed-in resonant point resistance 50Ω, and reactance should be close to zero. Therefore, the perfect impedance matching can be achieved, and electromagnetic radiation is triggered to transmit signals. The antenna structure is, a planar inverted-F antenna, and energy is passed from the signal feed-in wire 1310 to the second metal wire 1314 and the radiating conductor 1304 to generated a seventh resonant modal frequency having a higher frequency (that is, a seventh resonant modal frequency 1601 shown in FIG. 16). The seventh resonant modal frequency is controlled by a path from the open circuit terminal 1324 of the radiating conductor 1304 to the grounded second switching element 1318 which is connected to the radiating conductor 1304, and a length of the path equals to a quarter wavelength. When the seventh resonant modal frequency is generated, an eighth resonant modal frequency having a lower frequency (that is, an eighth resonant modal frequency 1602 shown in FIG. 16) is generated by a coupling manner, a length of its path is from the open circuit terminal 1322 of the radiating conductor 1304 to the second switching element 1318 which is connected to the open circuit terminal 1322 of the radiating conductor 1304 via a micro wire with a quarter wavelength to form a shorter circuit, and the length of its path equals to a quarter wavelength.

When the first switching element 1316 is switched and connected the second metal wire 1314, and the second switching element 1318 is switched to a short circuit via the second port (that is, via the resistor R1), one terminal of the radiating conductor 1304 is the open circuit terminal 1324 which is connected to the second switching element 1318 via a micro wire with a quarter wavelength to form a short circuit, there is a signal feed-in point between the open circuit terminal 1324 and the second switching element 1318. Impedance matching can be achieved by adjusting a distance between the signal feed-in wire 1310 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from the signal feed-in wire 1310 to the second metal wire 1314 and the radiating conductor 1304 to generate a ninth resonant modal frequency having a higher frequency (that is, a ninth resonant modal frequency 1603 shown in FIG. 16). The ninth resonant modal frequency is controlled by a path from the open circuit terminal 1324 of the radiating conductor 1304 to the grounded second switching element 1318 which is connected to the radiating conductor 1304, and a length of the path equals to a quarter wavelength. When the ninth resonant modal frequency is generated, a tenth resonant modal frequency having a higher frequency (that is, a tenth resonant modal frequency 1604 shown in FIG. 16) is generated by a coupling manner, and a length of its path is from the open circuit terminal 1322 of the radiating conductor 1304 to the second switching element 1318 which is connected to the open circuit terminal 1322 of the radiating conductor 1304 via a micro wire with a quarter wavelength to form a shorter circuit, and the length of its path equals to a quarter wavelength.

When the first switching element 1316 is switched and connected to the second metal wire 1314, and the second switching element 1318 is switched to a short circuit via the first port (that is, via the first inductor L1), one terminal of the radiating conductor 1304 is the open circuit terminal 1324 which is connected to the second switching element 1318 via a micro wire with a quarter wavelength to form a short circuit, and there is a signal feed-in point between the open circuit terminal 1324 and the second switching element 1318. Impedance matching can be achieved by adjusting a distance between the signal feed-in wire 1310 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from the signal feed-in wire 1310 to the second metal wire 1314 and the radiating conductor 1304 to generate a eleventh resonant modal frequency having a higher frequency (that is, a eleventh resonant modal frequency 1605 shown in FIG. 16). The resonant modal frequency is controlled by a path from the open circuit terminal 1324 of the radiating conductor 1304 to the grounded second switching element 1318 which is connected to the radiating conductor 1304, and a length of the path equals to a quarter wavelength. When the eleventh resonant modal frequency is generated, a twelfth resonant modal frequency having a lower frequency (that is, a twelfth resonant modal frequency 1606 shown in FIG. 16) is generated by a coupling manner, a length of its path is from the open circuit terminal 1322 of the radiating conductor 1304 to the second switching element 1318 which is connected to the open circuit terminal 1322 of the radiating conductor 1304 via a micro wire with a quarter wavelength to form a shorter circuit, and the length of its path equals to a quarter wavelength. The multi-band antenna integrated with the metal backing plate can obtain twelve resonant modal frequencies.

In this embodiment, the metal backing plate can be integrated with one or more substrates, and integration manners of the substrates and functions of the substrates are similar to the first embodiment illustrated previously. Although the non-conductor has the breakpoint, this difference is unable to affect a relationship of three-dimensional integration among the metal backing plate, the radiating conductor and the non-conductor, and the relationship of three-dimensional integration is also similar to the first embodiment illustrated previously, so will not be repeated.

Figure 14:
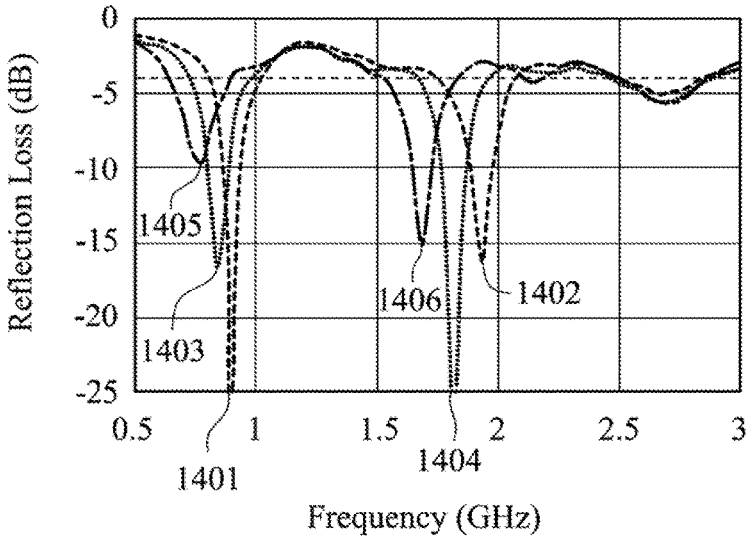
FIG. 14 is an operation reflection loss diagram of a first resonant modal frequency, a second resonant modal frequency, a third resonant modal frequency, a fourth resonant modal frequency, a fifth resonant modal frequency and a sixth resonant modal frequency according to one operation mode of the third embodiment of the present disclosure.

FIG. 14 is an operation reflection loss diagram of a first resonant modal frequency, a second resonant modal frequency, a third resonant modal frequency, a fourth resonant modal frequency, a fifth resonant modal frequency and a sixth resonant modal frequency according to one operation mode of the third embodiment of the present disclosure. As shown in FIG. 14, the antenna structure 1300 has the first resonant modal frequency 1401, the second resonant modal frequency 1402, the third resonant modal frequency 1403, the fourth resonant modal frequency 1404, the fifth resonant modal frequency 1405 and the sixth resonant modal frequency 1406. A voltage standing wave ratio having a ratio of 4.5:1 or a 4 dB reflection loss can be used as a standard of input impedance bandwidth. The impedance bandwidth of operation frequencies includes bandwidths required from communication bands of the code division multiple access 2000, the enhanced general packet radio service, the universal telecommunication system and the long term evolution system.

Figure 15:
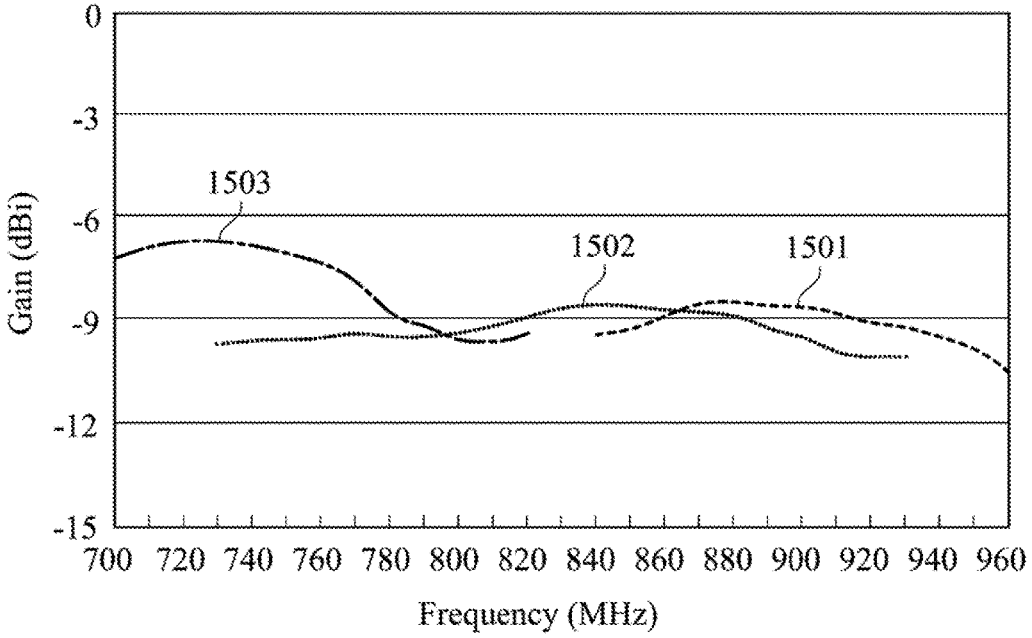
FIG. 15 is an operation modal gain diagram of the multi-band antenna integrated with the metal backing plate according to one operation mode of the third embodiment of the present disclosure.

FIG. 15 is an operation modal gain diagram of the multi-band antenna integrated with the metal backing plate according to one operation mode of the third embodiment of the present disclosure. As shown in FIG. 15, a curve 1501, a curve 1502 and a curve 1503 respectively represent antenna operation modal gains of the first resonant modal frequency 1401, the third resonant modal frequency 1403 and the fifth resonant modal frequency 1405.

Figure 16:
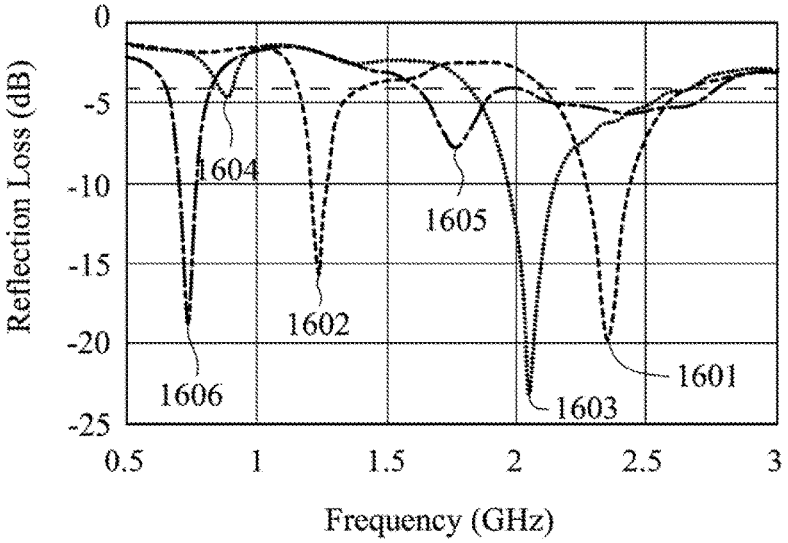
FIG. 16 is an operation reflection loss diagram of a seventh resonant modal frequency, an eighth resonant modal frequency, a ninth resonant modal frequency, a tenth resonant modal frequency, an eleventh resonant modal frequency and a twelfth resonant modal frequency according to the other operation mode of the third embodiment of the present disclosure.

FIG. 16 is an operation reflection loss diagram of a seventh resonant modal frequency, an eighth resonant modal frequency, a ninth resonant modal frequency, a tenth resonant modal frequency, a eleventh resonant modal frequency and a twelfth resonant modal frequency according to the other operation mode of the third embodiment of the present disclosure. As shown in FIG. 16, the antenna structure 1300 has the seventh resonant modal frequency 1601, the eighth resonant modal frequency 1602, the ninth resonant, modal frequency 1603, the tenth resonant modal frequency 1604, the eleventh resonant modal frequency 1605 and the twelfth resonant modal frequency 1606. A voltage standing wave ratio having a ratio of 4.5:1 or a 4 dB reflection loss can be used as a standard of input impedance bandwidth. The impedance bandwidth of operation frequencies includes bandwidths required from communication bands of the code division multiple access 2000, the enhanced general packet radio service, the universal telecommunication system and the long term evolution system.

Figure 17:
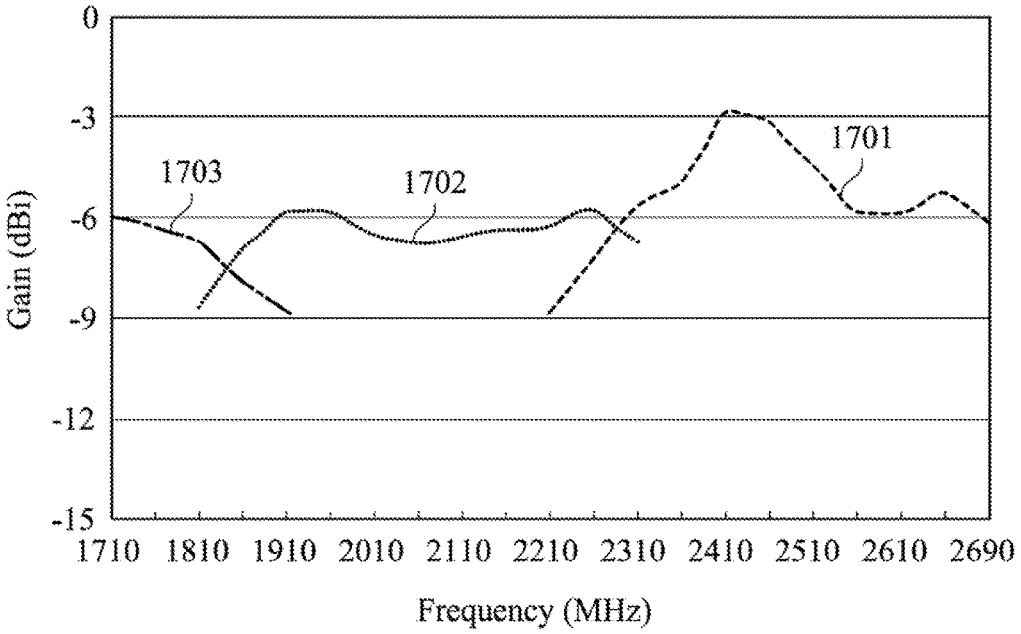
FIG. 17 is an operation modal gain diagram of the multi-band antenna integrated with the metal backing plate according to the other operation mode of the third embodiment of the present disclosure.

FIG. 17 is an operation modal gain diagram of the multi-band antenna integrated with the metal backing plate according to the other operation mode of the third embodiment of the present disclosure. As shown in FIG. 17, a curve 1701, a curve 1702 and a curve 1703 respectively represent antenna operation modal gains of the seventh resonant modal frequency 1601, the ninth resonant modal frequency 1603 and the eleventh resonant modal frequency 1605.

Figure 18:
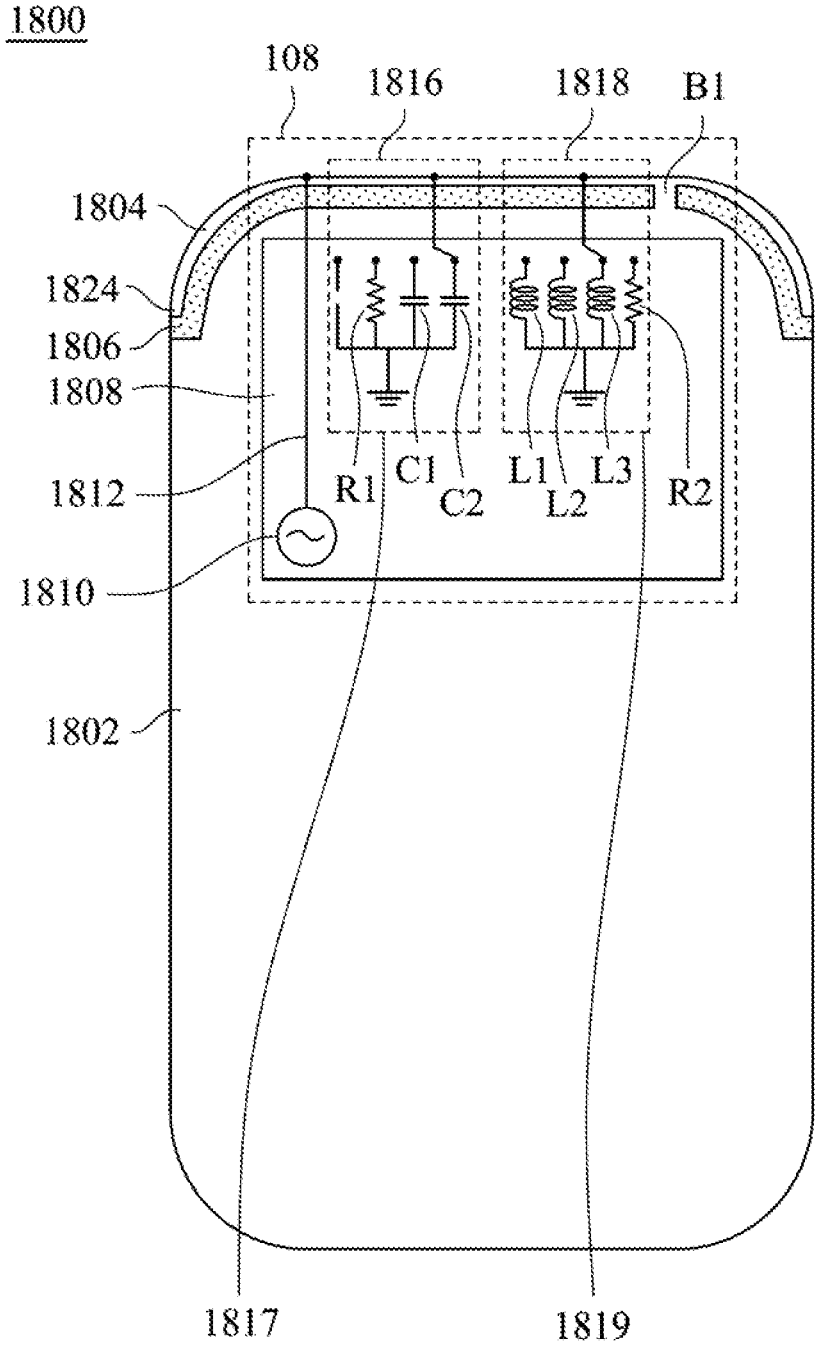
FIG. 18 is a design schematic diagram of a multi-band antenna integrated with a metal backing plate according to a fourth embodiment of the present disclosure.

FIG. 18 is a design schematic diagram of a multi-band antenna integrated with a metal backing plate according to a fourth embodiment of the present disclosure. In this embodiment, an antenna structure 1800 includes a metal backing plate 1802, a radiating conductor 1804, a non-conductor 1806, a substrate 1808, a signal feed-in wire 1810, a first metal wire 1812, a first switching element 1816 and a second switching element 1818.

The signal feed-in wire 1810 is connected to the radiating conductor 1804 via the first metal wire 1812. The first switching element 1816 and the second switching element 1818 are a one-to-many port switch 1817 and a one-to-many port switch 1819 respectively (in this embodiment, the first switching element 1816 and the second switching element 1818 are both one-to-four port switches). One terminal of the first switching element 1816 can be connected to ground selectively via a second port coupled to a first resistor R1, a third port coupled to a first capacitor C1 and a fourth port coupled to a second capacitor C2, and a first port is an open circuit terminal. The other of the first switching element 1816 is connected to the radiating conductor 1804. One terminal of the second switching element 1818 can be connected to ground selectively via a first port coupled to the inductor L1, a second port coupled to a second inductor L2, a third port coupled to a third inductor L3 and a fourth port coupled to a second resistor, and the other terminal of the second switching element 1818 is connected to the radiating conductor 1804. The inductance of the first inductor L1 is approximately smaller than the second inductor L2, the inductance of the second inductor L2 is approximately smaller than the third inductor L3, and the capacitance of the first capacitor C1 is approximately smaller than the second capacitor C2. The non-conductor 1806 is interleaved between the radiating conductor 1804 and the metal backing plate 1802. The non-conductor 1806 includes materials with different dielectric constants or non-conductive materials, and the non-conductor 1806 is mainly configured to support t he radiating conductor 1804 and the metal backing plate 1802.

In the fourth embodiment of the present disclosure, the metal backing plate 1802, the radiating conductor 1804, and the first metal wire 1812 all include metal elements, carbon fiber elements or any other elements with conductive materials. The signal feed-in wire 1810, the first metal wire 1812, the first switching element 1816 and the second switching element 1818 are all arranged on the substrate 1808. The substrate 1808 includes elements with non-conductive materials or materials with different dielectric constants (such as, an epoxy glass fiberboard or a flexible printed circuit board).

In the antenna structure 1800 of the fourth embodiment of the present disclosure, when the second switching element 1818 is switched and connected to radiating conductor 1804 via the fourth port (that is, via the second resistor R2), and the first switching element 1816 is switched to an open circuit, one terminal of the radiating conductor 1804 is an open circuit terminal 1824 which is connected to the second switching element 1818 via a micro wire with a quarter wavelength to form a short circuit, and there is a signal feed-in point between the open circuit terminal 1824 and the second switching element 1818. Impedance matching can be achieved by adjusting a distance between the signal feed-in wire 1810 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from the signal feed-in wire 1810 to the radiating conductor 1804 to generate a first resonant modal frequency having a lower frequency (that is, a first resonant modal frequency 1901 shown in FIG. 19). The first resonant modal frequency is controlled by a path from the open circuit terminal 1824 of the radiating conductor 1804 to the grounded second switching element 1818 which is connected to the radiating conductor 1804, and a length of the path equals to a quarter wavelength.

When the second switching element 1818 is switched and connected to the radiating conductor 1804 via the first port (that is, via the first inductor L1), and the first switching element 1816 is switched to an open circuit, one terminal of the radiating conductor 1804 is the open circuit terminal 1824 which is connected to the second switching element 1818 via a micro wire with a quarter wavelength to form a shorter circuit, and there is a signal feed-in point between the open circuit terminal 1824 and the second switching element 1818. Impedance matching can be achieved by adjusting a distance between the signal feed-in wire 1810 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from the signal feed-in wire 1810 to the radiating conductor 1804 to generate a second resonant modal frequency having a lower frequency (that is, a second resonant modal frequency 1902 shown in FIG. 19). The second resonant modal frequency is controlled by a path from the open circuit terminal 1824 of the radiating conductor 1804 to the grounded second switching element 1818 which is connected to the radiating conductor 1804, and a length of the path equals to a quarter wavelength.

When the second switching element 1818 is switched and connected to the radiating conductor 1804 via the second port (that is, via the second inductor L2), the first switching element 1816 is switched to an open circuit, one terminal of the radiating conductor 1804 is the open circuit terminal 1824 which is connected to the second switching element 1818 via a micro wire with a quarter wavelength to form a short circuit, and there is a signal feed-in point between the open circuit terminal 1824 and the second switching element 1818. Impedance matching can be achieved by adjusting a distance between the signal feed-in wire 1810 and a short circuit to find signal feed-in resonant point resistance 50Ω, and reactance should be dose to zero. Therefore, the perfect impedance matching can be achieved, and electromagnetic radiation is triggered to transmit signals. The antenna structure is a planar inverted-F antenna, and energy is passed from the signal feed-in wire 1810 to the radiating conductor 1804 to generate a third resonant modal frequency having a lower frequency (that is, a third resonant modal frequency 1903 shown in FIG. 19), The third resonant modal frequency is controlled by a path from the open circuit terminal 1824 of the radiating conductor 1804 to the grounded second switching element 1818 which is connected to the radiating conductor 1804, and a length of the path equals to a quarter wavelength.

When the second switching element 1818 is switched and connected to the radiating conductor 1804 via the third port (that is, via the third inductor L3), and the first switching element 1816 is switched to an open circuit, one terminal of the radiating conductor 1804 is the open circuit terminal 1824 which is connected to the second switching element 1818 via a micro wire with a quarter wavelength to form a short circuit, there is a signal feed-in point between the open circuit terminal 1824 and the second switching element 1818. Impedance matching can be achieved by adjusting a distance between the signal feed-in wire 1810 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from the signal feed-in wire 1810 to the radiating conductor 1804 to generate a fourth resonant modal frequency having a lower frequency (that is, a fourth resonant modal frequency 1904 shown in FIG. 19). The fourth resonant modal frequency is controlled by a path from the open circuit terminal 1824 of the radiating conductor 1804 to the grounded second switching element 1818 which is connected to the radiating conductor 1804, and a length of the path equals to a quarter wavelength.

When the second switching element 1818 is switched and connected to the radiating conductor 1804 via the fourth port (that is, via the second resistor R2), and the first switching element 1816 is switched and connected to the radiating conductor 1804 via the fourth (that is, via the second capacitor), one terminal of the radiating conductor 1804 is the open circuit terminal 1824 which is connected to the first switching element 1816 via a micro wire with a quarter wavelength to form a short circuit, and there is a signal feed-in point between the open circuit terminal 1824 and the first switching element 1816. Impedance matching can be achieved by adjusting a distance between the signal feed-in wire 1810 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from the signal feed-in wire 1810 to the radiating conductor 1804 to generate a fifth resonant modal frequency having a higher frequency (that is, a fifth resonant modal frequency 2101 shown in FIG. 21). The fifth resonant modal frequency is controlled by a path from the open circuit terminal 1824 of the radiating conductor 1804 to the grounded first switching element 1816 which is connected to the radiating conductor 1804, and a length of the path equals to a quarter wavelength.

When the second switching element 1818 is switched and connected to the radiating conductor 1804 via the fourth port (that is, via the second resistor R2), and the first switching element 1816 is switched and connected to the radiating conductor 1804 via the third port (that is, via the first capacitor C1), one terminal of the radiating conductor 1804 is the open circuit terminal 1824 which is connected to the first switching element 1816 via a micro wire with a quarter wavelength to form a short circuit, and there is a signal feed-in point between the open circuit terminal 1824 and the first switching element 1816. Impedance matching can be achieved by adjusting a distance between the signal feed-in wire 1810 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from the signal feed-in wire 1810 to the radiating conductor 1804 to generate a sixth resonant modal frequency having a higher frequency (that is, a sixth resonant modal frequency 2102 shown in FIG. 21). The sixth resonant modal frequency is controlled by a path from the open circuit terminal 1824 of the radiating conductor 1804 to the grounded first switching element 1816 which is connected to the radiating conductor 1804, and a length of the path equals to a quarter wavelength.

When the second switching element 1818 is switched and connected to the radiating conductor 1804 via the fourth port (that is, via the second resistor R2), and the first switching element 1816 is switched and connected to the radiating conductor 1804 via the second port (that is, via the first resistor R1), one terminal of the radiating conductor 1804 is the open circuit terminal 1824 which is connected to the first switching element 1816 via a micro wire with a quarter wavelength to form a short circuit, and there is a signal feed-in point between the open circuit terminal 1824 and the first switching element 1816. Impedance matching can be achieved by adjusting a distance between the signal feed-in wire 1810 and a short circuit to find signal feed-in resonant point resistance 50Ω, and reactance should be close to zero. Therefore, the perfect impedance matching can be achieved, and electromagnetic radiation is triggered to transmit signals. The antenna structure is a planar inverted-F antenna, and energy is passed from the signal feed-in wire 1810 to the radiating conductor 1804 to generate a seventh resonant modal frequency having a higher frequency (that is, a seventh resonant modal frequency 2103 shown in FIG. 21). The seventh resonant modal frequency is controlled by a path from the open circuit terminal 1824 of the radiating conductor 1804 to the grounded first switching element 1816 which is connected to the radiating conductor 1804, and a length of the path equals to a quarter wavelength. The multi-band antenna integrated with the metal backing plate can obtain seven resonant modal frequencies.

In this embodiment, the metal backing plate can be integrated with one or more substrates, and integration manners of the substrates and functions of the substrates are similar to the first embodiment illustrated previously. Although the non-conductor has the breakpoint, but this difference will not affect a relationship of three-dimensional integration among the metal backing plate, the radiating conductor and the non-conductor, and the relationship of three-dimensional integration is also similar to the first embodiment illustrated previously, so will not be repeated.

Figure 19:
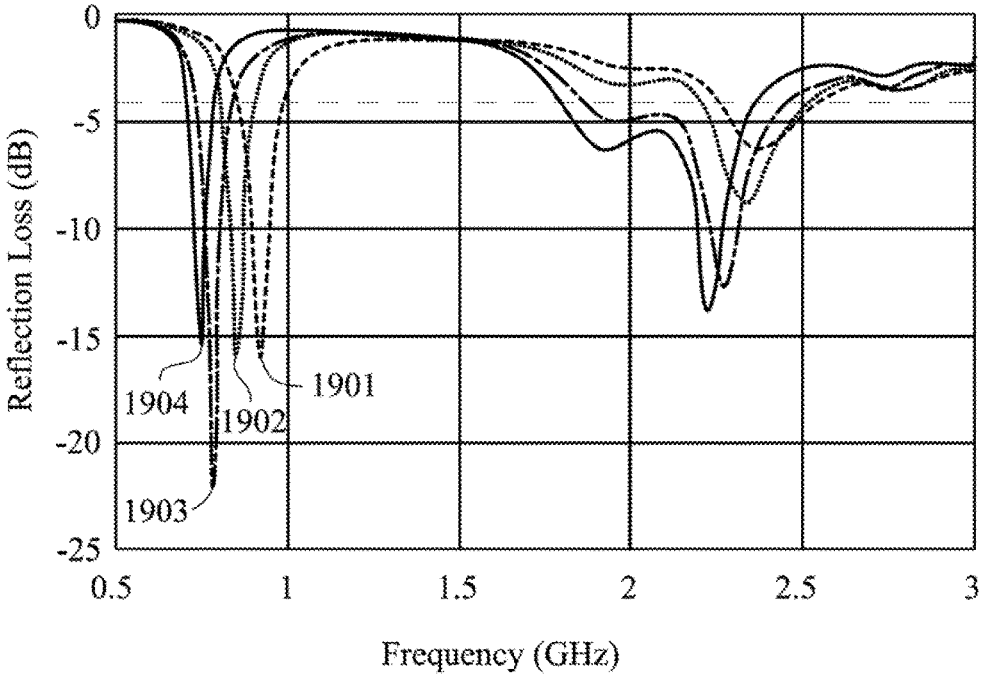
FIG. 19 is an operation reflection loss diagram of a first resonant modal frequency, a second resonant modal frequency, a third resonant modal frequency and a fourth resonant modal frequency according to one operation mode of the fourth embodiment of the present disclosure.

FIG. 19 is an operation reflection loss diagram of a first resonant modal frequency, a second resonant modal frequency, a third resonant modal frequency and a fourth resonant modal frequency according to one operation mode of the fourth embodiment of the present disclosure. As shown in FIG. 19, the antenna structure 1800 has the first resonant modal frequency 1901, the second resonant modal frequency 1902 the third resonant modal frequency 1903 and the fourth resonant modal frequency 1904. A voltage standing wave ratio having a ratio of 4.5:1 or a 4 dB reflection loss can be used as a standard of input impedance bandwidth. The impedance bandwidth of operation frequencies includes bandwidths required from communication bands of the code division multiple access 2000, the enhanced general packet radio service, the universal telecommunication system and the long term evolution system.

Figure 20:
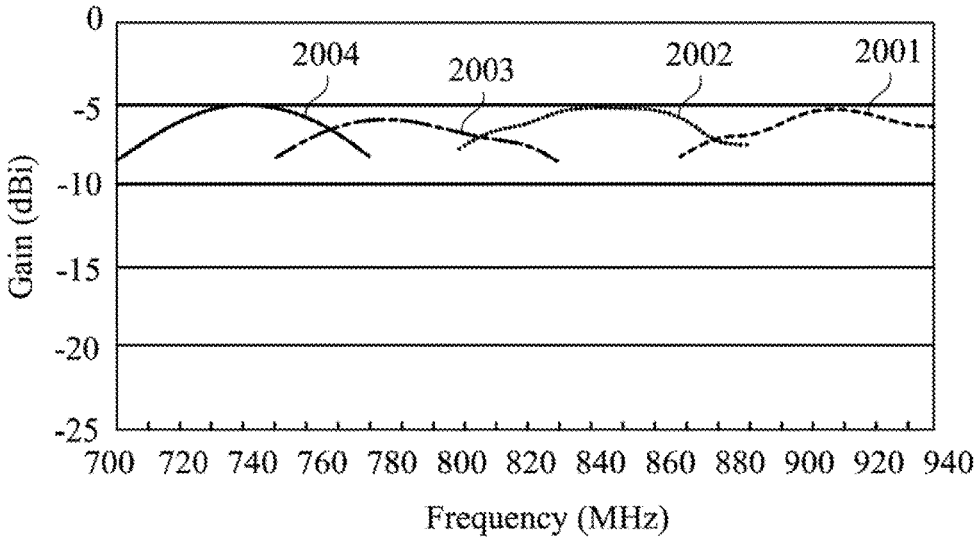
FIG. 20 is an operation modal gain diagram of the multi-band antenna integrated with the metal backing plate according to one operation mode of the fourth embodiment of the present disclosure.

FIG. 20 is an operation modal gain diagram of the multi-band antenna integrated with the metal backing plate according to one operation mode of the fourth embodiment of the present disclosure. As shown in FIG. 20, a curve 2001, a curve 2002, a curve 2003 and a curve 2004 respectively represent antenna operation modal gains of the first resonant modal frequency 1901, the second resonant modal frequency 1902, the third resonant modal frequency 1903 and the fourth resonant modal frequency 1904.

Figure 21:
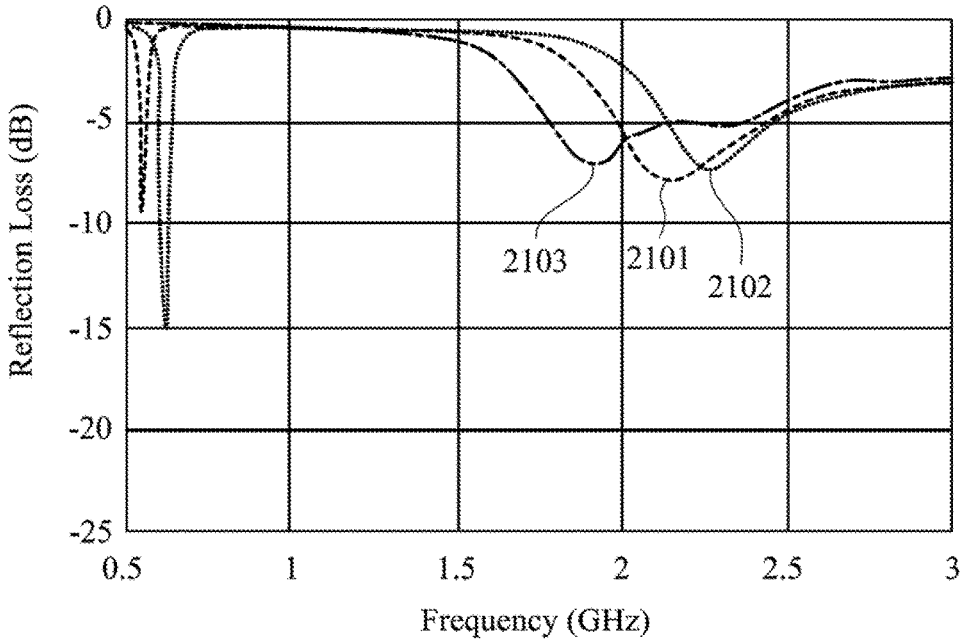
FIG. 21 is an operation reflection loss diagram of a fifth resonant modal frequency, a sixth resonant modal frequency and a seventh resonant modal frequency according to the other operation mode of the fourth embodiment of the present disclosure.

FIG. 21 is an operation reflection loss diagram of a fifth resonant modal frequency, a sixth resonant modal frequency and a seventh resonant modal frequency according to the other operation mode of the fourth embodiment of the present disclosure. As shown in FIG. 21, the antenna structure 1800 has the fifth resonant modal frequency 2101, the sixth resonant modal frequency 2102 and the seventh resonant modal frequency 2103. A voltage standing wave ratio having a ratio of 4.5:1 or a 4 dB reflection loss can be used as a standard of input impedance bandwidth. The impedance bandwidth of operation frequencies includes bandwidths required from communication bands of the code division multiple access 2000, the enhanced general packet radio service, the universal telecommunication system and the long term evolution system.

Figure 22:
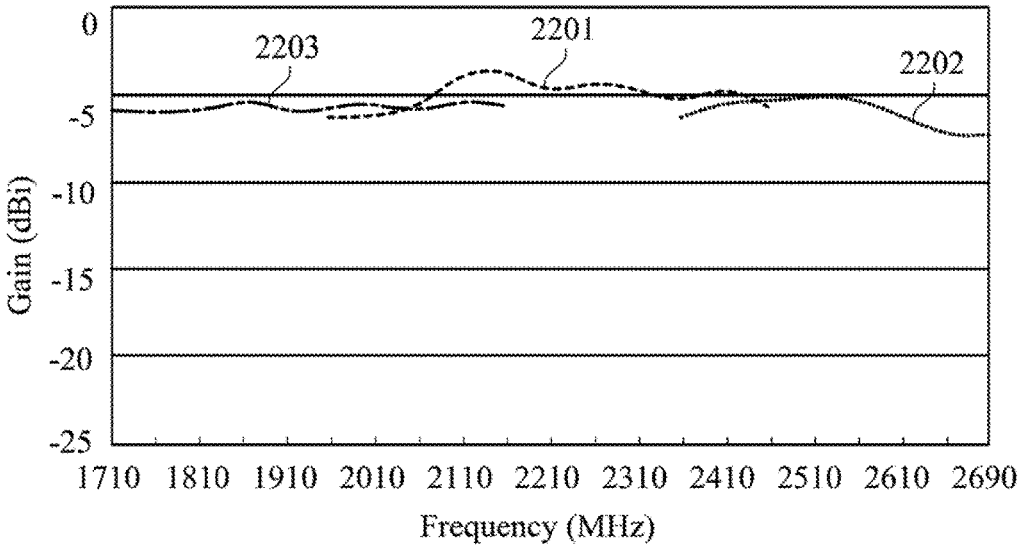
FIG. 22 is an operation modal gain diagram of the multi-band antenna integrated with the metal backing plate according to the other operation mode of the fourth embodiment of the present disclosure.

FIG. 22 is an operation modal gain diagram of the multi-band antenna integrated with the metal backing plate according to the other operation mode of the fourth embodiment of the present disclosure. As shown in FIG. 22, a curve 2201, a curve 2202 and a curve 2203 respectively represent antenna operation modal gains of the fifth resonant modal frequency 2101, the sixth resonant modal frequency 2102 and the seventh resonant modal frequency 2103.

FIGS. 23A, 238, 23C and 23D are schematic diagrams of defining a non-conductor dividing metal according to some embodiments of the present disclosure. Firstly, it is defining that the non-conductor 2306 includes a first terminal 2306*a* and a second terminal 2306*b*, and the non-conductor 2306 is interleaved between the metal backing plate 2302 and the radiating conductor 2304. The non-conductor 2306 is closely connected to the metal backing plate 2302 and the radiating conductor 2304. Specifically, the exterior of the metal backing plate 2302 is extended to the radiating conductor 2304 via the first terminal 2306*a*, and the section between the exterior of the metal backing plate 2302 and the radiating conductor 2304 is smooth or without obviously concave-convex bump. The exterior of the metal backing plate 2302 is extended to the radiating conductor 2304 via the second terminal 2306*b*, and the section between the exterior of the metal backing plate 2302 and the radiating conductor 2304 is smooth or without obviously concave-convex bump.

Secondly, one point of the top and the bottom of the metal backing plate is used as a base point, and a length 2300 is extended from the base point to its opposite side. If there is a non-conductor 2308 in this extension range, the non-conductor 2308 includes a third terminal 2308*a* and a fourth terminal 2308*b*. The third terminal 2308*a* and the first terminal 2306*a* are located on the same side, and the fourth terminal 2308*b* and the second terminal 2306*b* are located on the same side.

Figure 23A:
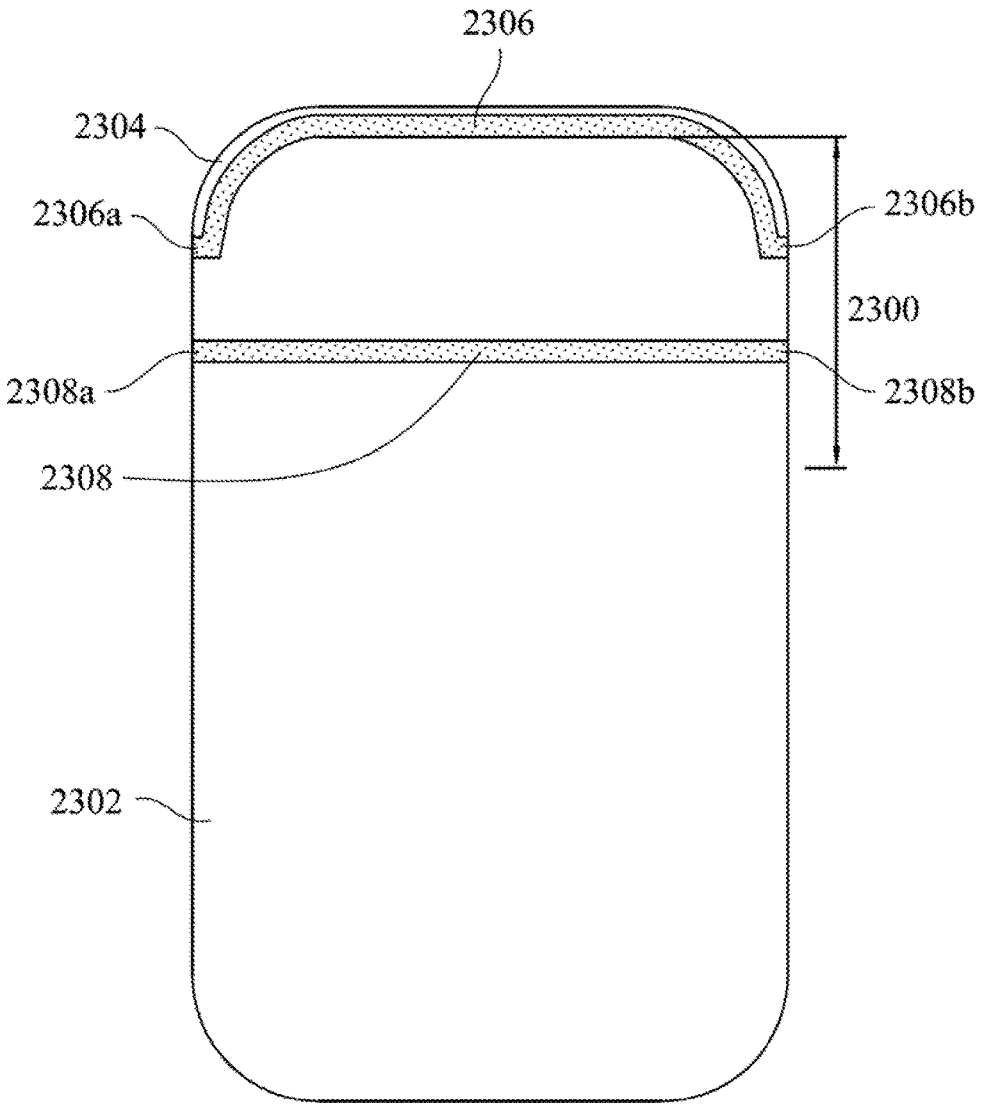
FIGS. 23A, 23B, 23C and 23D are schematic diagrams of defining a non-conductor dividing metal according to some embodiments of the present disclosure.

As shown in FIG. 23A, one point of the top and the bottom of the metal backing plate 2302 is used as a base point, and the length 2300 is extended from the base point to its opposite side. There is a non-conductor 2308 in this extension range. The non-conductor 2308 is extended from the third terminal 2308*a* of the exterior of the metal backing plate 2302 to the fourth terminal 2308*b* of the exterior of the metal backing plate 2302, and the non-conductor 2308 is similar to the non-conductor 2306 which is extended from the first terminal 2306*a* to the second terminal 2306*b*. The extension direction of the non-conductor 2308 is perpendicular to the extension direction of the extension length 2300. Therefore, the embodiment disclosed in FIG. 23A is incompatible with the characteristic of "the non-conductor dividing the metal" disclosed in the present disclosure.

Figure 23B:
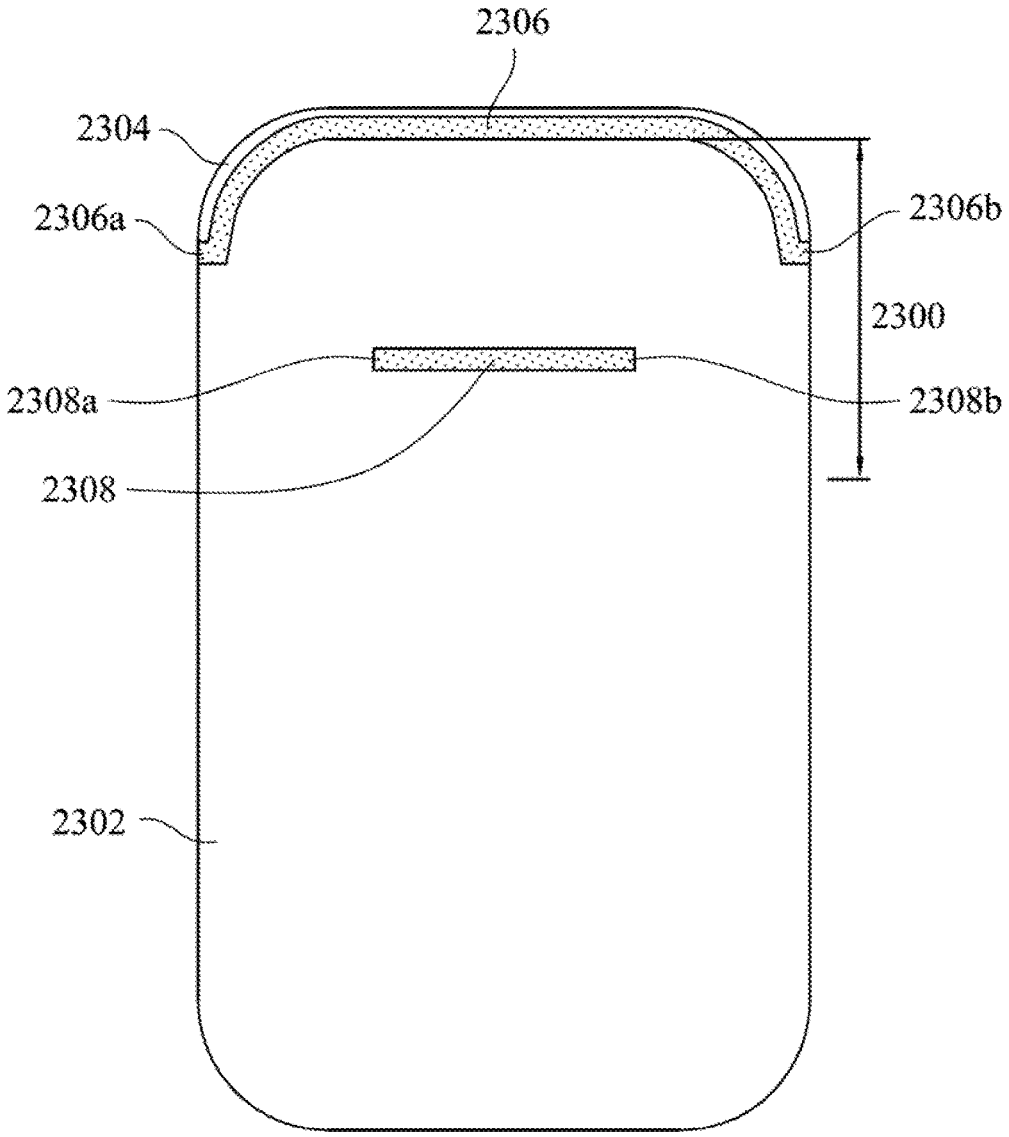

As shown in FIG. 23B, one point of the top and the bottom of the metal backing plate 2302 is used as a base point, and the length 2300 is extended from the base point to its opposite side. There is a non-conductor 2308 in this extension range. The non-conductor 2308 is extended from the third terminal 2308*a* of the interior of the metal backing plate 2302 to the fourth terminal 2308*b* of the interior of the metal backing plate 2302, and the non-conductor 2308 is different from the non-conductor 2306 which is extended from the first terminal 2306*a* to the second terminal 2306*b*. The extension direction of the non-conductor 2308 is perpendicular to the extension direction of the extension length 2300. Therefore, the embodiment disclosed in FIG. 23B is compatible with the characteristic of "the non-conductor dividing the metal" disclosed in the present disclosure.

Figure 23C:
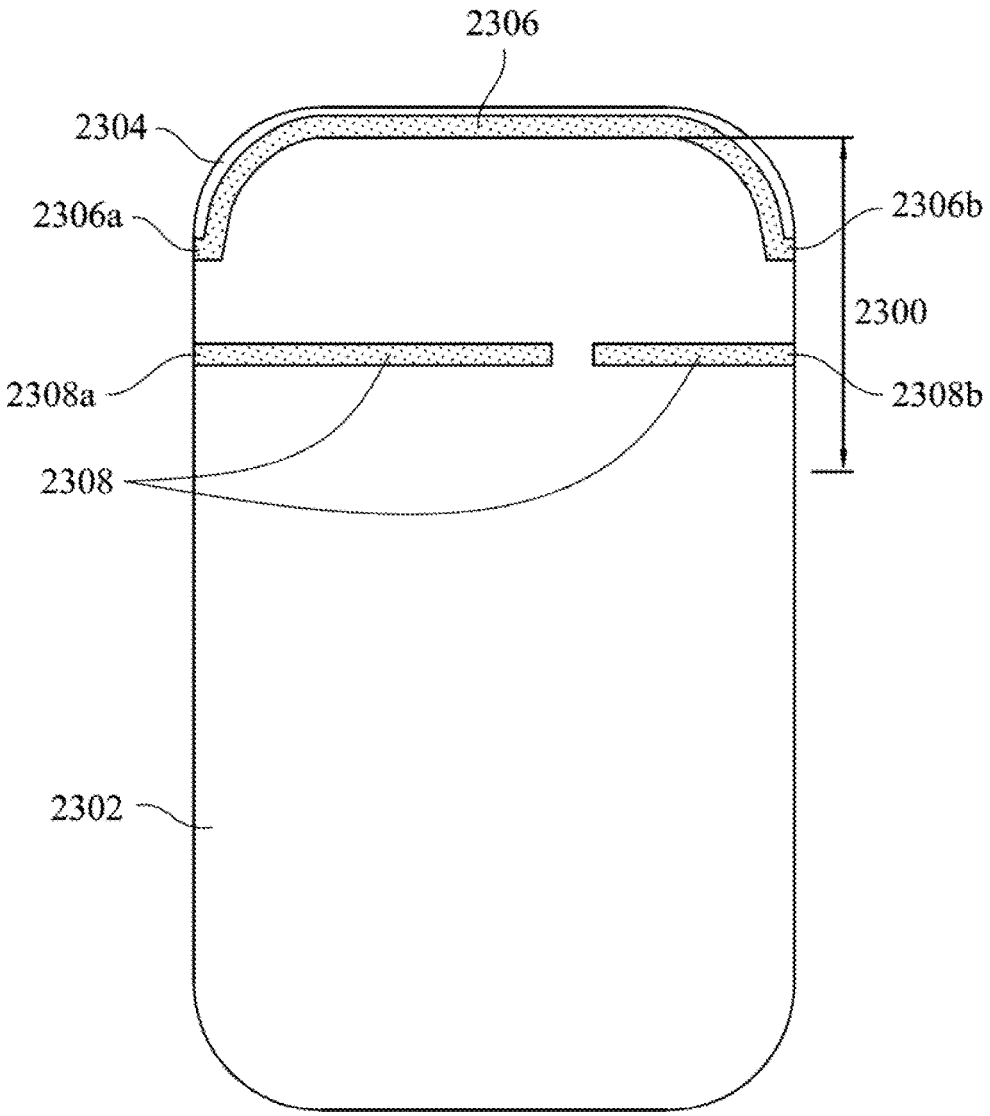

As shown in FIG. 23C, one point of the top and the bottom of the metal backing plate 2302 is used as a base point, and the length 2300 is extended from the base point to its opposite side. There is a non-conductor 2308 having a breakpoint. The non-conductor 2308 is extended form the third terminal 2308*a* of the exterior of the metal backing plate 2302 to the fourth terminal 2308*b* of the exterior of the metal backing plate 2302, and the non-conductor 2308 is similar to the non-conductor 2306 which is extended from the first terminal 2306*a* to the second terminal 2306*b*. The extension direction of the non-conductor 2308 is perpendicular to the extension direction of the extension length 2300. Therefore, the embodiment disclosed in FIG. 23C is incompatible with the characteristic of "the non-conductor dividing the metal" disclosed in the present disclosure.

Figure 23D:
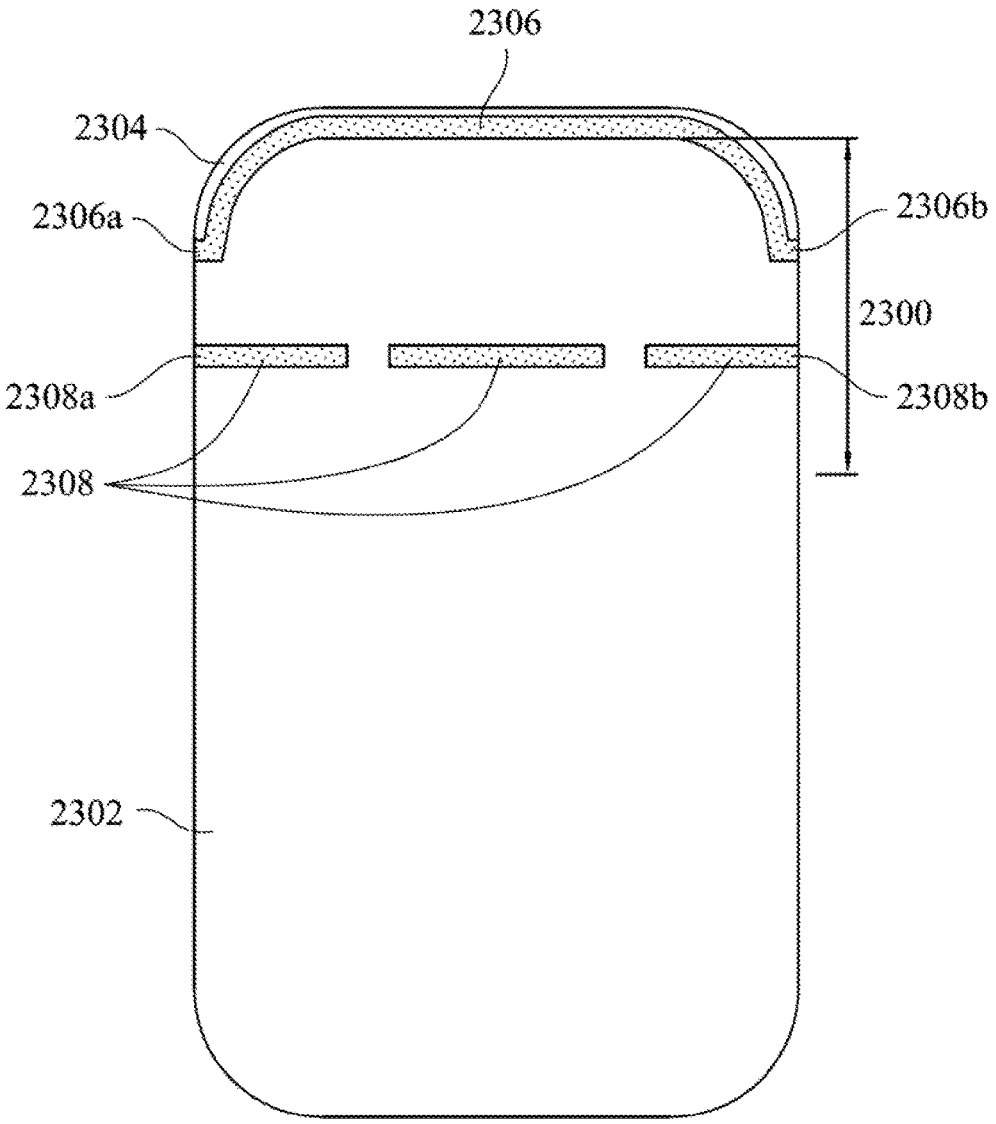

As shown in FIG. 23D, one point of the top and the bottom of the metal backing plate 2302 is used as a base point, end the length 2300 is extended from the base point to its opposite side. There is a non-conductor 2308 having several breakpoints. The non-conductor 2308 is extended from the third terminal 2308*a* of the exterior of the metal backing plate 2302 to the fourth terminal 2308*b* of the exterior of the metal backing plate 2302, and the non-conductor 2308 is similar to the non-conductor 2306 which is extended from the first terminal 2306*a* to the second terminal 2306*b*. The extension direction of the non-conductor 2308 is perpendicular to the extension direction of the extension length 2300. Therefore, the embodiment disclosed in FIG. 23D is incompatible with the characteristic of "the non-conductor dividing the metal" disclosed in the present disclosure. It should be noted that, the above-mentioned embodiments are examples for defining the non-conductor dividing the metal, but the present disclosure is not limited thereto.

By applying the above-mentioned embodiments of the present disclosure and by disposing additional connectors in the antenna structure, the appearance of the metal backing plate can be optimized, while at the same time the operation of the antenna resonant modal can be maintained. It should be noted that, the sizes of the elements and the components disclosed in the embodiment of the present disclosure are examples for facilitating of understanding. In other words, the sizes of the elements and the components can be possible embodiments of the present disclosure, but the present disclosure is not limited thereto. Persons skilled in the art can adjust the sizes of the elements and the components according to their practical requirements.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present invention cover modifications and variations of this present disclosure provided they fall within the scope of the following claims.

What is claimed is:

1. A multi-band antenna, comprising:

a metal backing plate;

a radiating conductor;

a non-conductor, between the metal backing plate and the radiating conductor; and a connector, connected to the metal backing plate and the radiating conductor, wherein the connector is configured to adjust a connection path between the metal backing plate and the radiating conductor to adjust an antenna operation band, and the connector comprises:

a plurality of metal wires, one terminal of each of the metal wires being connected to the radiating conductor;

a first switching element selectively switching such that one terminal of the first switching element being connected to the radiating conductor via one of the metal wires;

a second switching element configured to control connection between the radiating conductor and ground;

a signal feed-in wire connected to the other terminal of the first switching element, and configured to provide energy to an antenna device; and wherein the multi-band antenna forms one of a plurality of inverted-F antenna structure based on switching of the first switching element and switching of the second switching element.

2. The multi-band antenna of claim 1, wherein the non-conductor comprises a breakpoint dividing the non-conductor into two regions, and the metal backing plate is connected to the radiating conductor via the breakpoint.

3. The multi-band antenna of claim 1, wherein the non-conductor comprises a plastic element.

4. The multi-band antenna of claim 1, wherein the connector comprises at least one switching connector.

5. The multi-band antenna of claim 1, wherein the connector comprises:

a substrate, the metal wires, the first switching element, the second switching element and the signal feed-in wire being all arranged on the substrate.

6. The multi-band antenna of claim 5, wherein the second switching element is connected to one or more resistance matching elements, capacitance matching elements or inductance matching elements.

7. The multi-band antenna of claim 5, wherein the first switching element comprises a one-to-many port switch.

8. The multi-band antenna of claim 5, wherein the second switching element comprises a one-to-many port switch.

9. The multi-band antenna of claim 7, wherein the metal wires are arranged across the non-conductor and connects to the radiating element.

10. The multi-band antenna of claim 8, wherein each port of the second switching element is connected to one or more resistance matching elements, capacitance matching elements or inductance matching elements.

* * * * *